US010494787B2

(12) United States Patent
Takemura et al.

(10) Patent No.: US 10,494,787 B2
(45) Date of Patent: Dec. 3, 2019

(54) WORKING MACHINE

(71) Applicant: KUBOTA CORPORATION, Osaka (JP)

(72) Inventors: Toshihiko Takemura, Osaka (JP); Shunichiro Mori, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 16/010,085

(22) Filed: Jun. 15, 2018

(65) Prior Publication Data

US 2018/0347143 A1 Dec. 6, 2018

Related U.S. Application Data

(62) Division of application No. 14/862,468, filed on Sep. 23, 2015, now Pat. No. 10,072,391.

(30) Foreign Application Priority Data

Sep. 30, 2014 (JP) ..... 2014-202385
Sep. 30, 2014 (JP) ..... 2014-202386
Sep. 30, 2014 (JP) ..... 2014-202393

(51) Int. Cl.
*E02F 3/34* (2006.01)
*E02F 3/42* (2006.01)

(52) U.S. Cl.
CPC ..... *E02F 3/3414* (2013.01); *E02F 3/34* (2013.01); *E02F 3/3405* (2013.01); *E02F 3/422* (2013.01)

(58) Field of Classification Search
None
See application file for complete search history.

(56) References Cited

U.S. PATENT DOCUMENTS 5,807,061 A 9/1998 Donoghue
8,459,927 B2 6/2013 England
(Continued)

FOREIGN PATENT DOCUMENTS

JP H04-341496 11/1992
JP 2006-183405 7/2006
(Continued)

OTHER PUBLICATIONS

Notification of Reasons for Refusal in counterpart application No. P2014-202385, dated Nov. 21, 2017.
(Continued)

*Primary Examiner* — Ronald P Jarrett
(74) *Attorney, Agent, or Firm* — Greenblum & Bernstein, P.L.C.

(57) ABSTRACT

A working machine includes: a boom base portion including: an inner side wall; and an outer side wall disposed opposite to the inner side wall; a lift link disposed on a rear portion of the boom base portion; and a boom cylinder disposed in front of the lift link. One end side of the lift link is inserted between the inner side wall and the outer side wall and is pivotally supported on the boom base portion. The other end side of the lift link is pivotally supported on the machine body. One end of the boom cylinder is inserted between the inner side wall and the outer side wall in front of the lift link and is pivotally supported on the boom base portion. The other end of the boom cylinder is pivotally supported on the machine body by below the lift link.

4 Claims, 18 Drawing Sheets

(56) References Cited

U.S. PATENT DOCUMENTS

| | | | | |
|---|---|---|---|---|
| 8,821,104 | B2 | 9/2014 | Yasuda | |
| 2008/0193269 | A1* | 8/2008 | Sakada | E02F 3/34<br>414/722 |
| 2010/0003117 | A1 | 1/2010 | Yamashita et al. | |

FOREIGN PATENT DOCUMENTS

| | | |
|---|---|---|
| JP | 2007063819 | 3/2007 |
| JP | 2010-59684 | 3/2010 |
| JP | 2013253394 | 12/2013 |

OTHER PUBLICATIONS

Notification of Reasons for Refusal in counterpart application No. P2014-202393, dated Nov. 21, 2017.
Notification of Reasons for Refusal in counterpart application No. P2014-202386, dated Nov. 28, 2017.

* cited by examiner

WORKING MACHINE

CROSS-REFERENCE TO RELATED APPLICATIONS

The present application is a divisional application of U.S. application Ser. No. 14/862,468, filed Sep. 23, 2015, which claims priority under 35 U.S.C. § 119 to Japanese Patent Application No. 2014-202386, filed Sep. 30, 2014, to Japanese Patent Application No. 2014-202385, filed Sep. 30, 2014, and to Japanese Patent Application No. 2014-202393, filed Sep. 30, 2014. The entire disclosure of each of these applications are expressly incorporated by reference herein.

BACKGROUND OF THE INVENTION

Field of the Invention

The present invention relates to a working machine such as a skid steer loader, a track loader, and a compact track loader.

Description of Related Art

A working machine disclosed in Japanese Unexamined Patent Application Publication No. 2010-59684 is previously known. The working machine includes: a machine body; an operator seat mounted on the machine body; a right boom arranged on a right side to the operator seat; and a left boom arranged on a left side to the operator seat. Each of the booms includes a boom base portion disposed on a position corresponding to a rear portion side of the machine body. Each of the boom base portion is provided with a lift link. The lift link is pivotally supported by the boom base portion at one end side of the lift link, and is pivotally supported by the machine body at the other end side of the lift link. In addition, a boom cylinder is disposed in front of the lift link, the boom cylinder being configured to swing the boom. Accordingly, the lift link is pivotally supported by the boom base portion, the boom cylinder is disposed in front of the lift link, and thereby the boom can be swung.

A working machine disclosed in Japanese Unexamined Patent Application Publication No. 2010-59684 is previously known. The working machine includes: a machine body; an operator seat mounted on the machine body; a right boom arranged on a right side to the operator seat, the right boom being configured to swing upward and downward; a left boom arranged on a left side to the operator seat, the left boom being configured to swing upward and downward; a first boom from portion included on a front portion of the right boom; a second boom front portion included on a front portion of the left boom; and a joint pipe configured to joint the first boom front portion to the second boom front portion. The joint pipe is formed to have a trapezoid cross section.

In addition, a pivot shaft is disposed on a tip end portion of the boom, and an attachment portion is supported by the pivot shaft to be capable of freely turning about the pivot shaft. An operation tool such as a bucket and the like is attached to the attachment portion, the operation tool being configured to be attached to and detached from the attachment portion. Furthermore, an operation tool cylinder is disposed on each of the boom front portion, the operation tool cylinder being a hydraulic cylinder used for turning the attachment portion.

A working machine disclosed in Japanese Unexamined Patent Application Publication No. 2010-59684 is previously known. The working machine includes: a machine body; an operation tool; and a boom configured to swing upward and downward. In addition, a pivot shaft is disposed on a tip end portion of the boom, and an attachment body is supported by the pivot shaft to be capable of freely turning about the pivot shaft. An operation tool such as a bucket and the like is attached to the attachment body, the operation tool being configured to be attached to and detached from the attachment body.

In order to restrict an end position of a turning track of the operation tool when the operation tool is turned to one direction or the other direction, the working machine is provided with: a restriction stopper; and a contact portion configured to contact to the restriction stopper.

The restriction stopper is disposed on the tip end portion of the boom, and the contact portion is disposed on the attachment body. The contact portion contacts to the restriction stopper when the operation tool is turned to one direction or to the other direction about the pivot shaft, thereby restricting the end position of the turning track of the operation tool (the attachment body).

The boom is disposed on a right side of the machine body. Another boom is disposed on a left side of the machine body. The attachment body is disposed on each of the booms. In particular, the attachment body disposed on the right side is arranged on a left side of the tip end side of the boom disposed on the right side, and the attachment body disposed on the left side is arranged on a right side of the tip end side of the boom disposed on the left side. The attachment bodies are jointed to each other. A working machine having another configuration is also disclosed, the working machine having the contact portion on an outer side surface of the attachment body and having the restriction stopper on a lower end side of the tip end side of the boom.

BRIEF SUMMARY OF THE INVENTION

Problems to be Solved by the Invention

For enlargement of a space around the operator seat, it is required for the working machine to enlarge an interval between the booms as large as possible. On the other hand, for improvement of operability of the working machine, it is required for the working machine to minimize a turning radius of the machine body as small as possible. However, in the previously-known working machine, a support structure protrudes outward from the machine body when the interval between the booms is enlarged, the support structure being constituted of the boom base portion, the lift link, the boom cylinder, and the like. As the result of the enlargement, the turning radius of the working machine will be large.

To solve the above mentioned problems, the present invention intends to provide a working machine capable of reducing a turning radius of the working machine and of forming an enough space around the operator seat.

In the previously-known working machine, mechanical stress tends to be concentrated on a portion jointing the joint pipe to the boom. The working machine is provided with a reinforcement rib for reducing the mechanical stress. The reinforcement rib causes increase of weight of the working machine.

Additionally, there is a working machine, the working machine also being previously known. In arrangement of a hydraulic hose to the operation tool cylinder, this previously known working machine branches the hydraulic hose at a center of the joint pipe to arrange the hydraulic hose to the operation tool cylinder. In this working machine, a volume of the hydraulic hose lying on the joint pipe is large, a cover for covering the hydraulic hose is large, the hydraulic hose lying on the joint pipe, and thereby the hydraulic hose and the cover may deteriorate a front visibility of the working machine.

To solve the above mentioned problems, the present invention intends to provide a working machine capable of suppressing the concentration of mechanical stress in the joint portion between the boom and the joint pipe. In addition, the present invention intends to provide a working machine capable of suppressing the volume of the hydraulic hose lying on the joint pipe.

When the contact portion is disposed on an outside surface of the attachment body and the restriction stopper is disposed on a lower end side of the tip end portion of the boom, the contact portion has to protrude from the outside surface of the attachment body toward the tip end portion of the boom. When the contact portion protrudes from the outside surface of the attachment body toward the tip end portion of the boom, the contact portion contacts to the restriction stopper after the operation tool turns, thereby applying a large load to an attachment portion of the contact portion, the attachment portion being attached to the attachment body.

To solve the above mentioned problems, the present invention intends to provide a working machine capable of reducing the load applied to a contact portion, the contact portion being disposed on the attachment body.

Means of Solving the Problems

To solve the above-mentioned technical problems, techniques that the present invention provides are characterized in the following points.

In a first aspect of the present invention, a working machine includes: a machine body; an operator seat mounted on the machine body; a boom disposed on a right side of or a left side of the operator seat; a boom base portion disposed on a position corresponding to a rear portion side of the machine body, the boom base portion including: an inner side wall; and an outer side wall disposed opposite to the inner side wall; a lift link disposed on a rear portion of the boom base portion; a first pivot shaft configured to pivotally support one end side of the lift link; a second pivot shaft configured to pivotally support the other end side of the lift link; a boom cylinder disposed in front of the lift link, the boom cylinder being configured to swing the right boom upward and downward; a third pivot shaft configured to pivotally support one end side of the boom cylinder; and a fourth pivot shaft configured to pivotally support the other end side of the boom cylinder, wherein one end side of the lift link is inserted between the inner side wall and the outer side wall and is pivotally supported on the boom base portion by the first pivot shaft, the other end side of the lift link is pivotally supported on the machine body by the second pivot shaft, one end of the boom cylinder is inserted between the inner side wall and the outer side wall in front of the lift link and is pivotally supported on the right boom base portion by the right third pivot shaft, the other end of the boom cylinder is pivotally supported on the machine body by the fourth pivot shaft below the lift link.

In a second aspect of the present invention, the machine body includes: a pair of support walls, one of the support walls being arranged on one side of the other end side of the lift link, the other one of the support walls being arranged on the other side of the other end side of the lift link; and a rear wall arranged behind the lift link, the rear wall being configured to joint the pair of support walls to each other, and the second pivot shaft is disposed between the pair of support walls, the second pivot shaft is disposed between the pair of support walls, and the lift link is formed to have a curved shape protruding a center portion of the curved shape forward in a longitudinal direction in a side view.

In a third aspect of the present invention, the lift link has a cross section shaped in T-shape in a horizontal direction.

In a fourth aspect of the present invention, a working machine includes: a machine body; an operator seat mounted on the machine body; a right boom disposed on a right side of the operator seat, the right boom being configured to be swung upward and downward; a left boom disposed on a left side of the operator seat, the left boom being configured to be swung upward and downward; a right boom front portion being a front portion of the right boom; a left boom front portion being a front portion of the left boom; and a joint pipe configured to joint the right boom front portion and the left boom front portion to each other, the joint pipe including: a first wall; a second wall disposed in front of the first wall; and a third wall configured to joint one end of the first wall and one end of the second wall to each other, the first wall being formed to have a shape curved toward the second wall, the second wall being formed to have a shape curved forward, the more the first wall and the second wall separating from the third wall, the more the first wall and the second wall being close to each other.

In a fifth aspect of the present invention, the working machine according to the fourth aspect of the present invention, includes: a right travel device disposed on a right side of the machine body; and a left travel device disposed on a left side of the machine body, wherein the right boom front portion includes: a right insertion concave portion, the left boom front portion includes: a left insertion concave portion, the joint pipe is inserted to the right insertion concave portion and to the left insertion concave portion, and the first wall has a shape corresponding to shapes of front wheels included in the right travel device and the left travel device.

In a sixth aspect of the present invention, a working machine includes: a machine body; an operator seat mounted on the machine body; a right boom disposed on a right side of the operator seat, the right boom being configured to be swung upward and downward; a left boom disposed on a left side of the operator seat, the left boom being configured to be swung upward and downward; a right boom front portion being a front portion of the right boom; a left boom front portion being a front portion of the left boom; a joint pipe configured to joint the right boom front portion and the left boom front portion to each other; an operation tool pivotally supported on a side of the right boom front portion and on a side of the left boom front portion, the operation tool being capable of swinging; a right hydraulic actuator disposed on the right boom, the right hydraulic actuator being configured to move the operation tool; a left hydraulic actuator disposed on the left boom, the left hydraulic actuator being configured to move the operation tool; and a hydraulic hose extending from a rear portion of the right boom or the left boom toward a front portion of the right boom or the left boom, the hydraulic hose being branched on the side of the front portion of the right boom or the left boom and being connected to the right hydraulic actuator and to the left hydraulic actuator.

In a seventh aspect of the present invention, the working machine according to the sixth aspect of the present invention, includes: a pair of brackets fixed to the joint pipe, each of the brackets including: a restriction concave portion; and a boarding step attached to the pair of brackets by bolts, the boarding step being configured to be attached to and detached from the pair of brackets, the boarding step including: a restriction portion configured to be inserted to the restriction concave portion to restrict turn of the boarding step about the bolts.

In an eighth aspect of the present invention, the working machine according to the seventh aspect of the present invention, includes: a hose cover configured to cover the hydraulic hose extended along the joint pipe, the hose cover being fixed to a position on the joint pipe and adjacent behind the boarding step.

In a ninth aspect of the present invention, a working machine includes: a machine body; an operation tool; a boom configured to swing upward and down ward; a pivot shaft disposed on a front portion of the boom, the front portion of the boom including: an outer wall; and an inner wall disposed opposite to the outer wall; a restriction stopper disposed on the front portion of the boom, the restriction stopper being disposed on a side of the inner wall, the side being opposite to the outer wall; an attachment body supported by the pivot shaft to be capable of freely turning, the attachment body being for attachment of the operation tool, the attachment body including: a support plate disposed on a position corresponding to the restriction stopper, the position being on a side of the inner wall, the side being opposite to the outer wall; a contact portion configured to move when the attachment body turns, the contact portion being configured to contact to the restriction stopper, the contact portion being disposed on the support plate.

In a tenth aspect of the present invention, the contact portion is disposed on an outer circumferential surface of the support plate.

In an eleventh aspect of the present invention, the front portion of the boom includes: a boss portion configured to support the pivot shaft, and the restriction stopper is disposed above a lower end of the boss portion.

In a twelfth aspect of the present invention, the restriction stopper is disposed on a position where the restriction stopper does not protrude downward from the boss portion under a state where the boom is fully lifted up.

In a thirteenth aspect of the present invention, the contact portion includes: a first contact portion disposed on an outer circumferential surface of the support plate, the first contact portion configured to contact to the restriction stopper when the operation tool is turned to one direction; and a second contact portion disposed on the outer circumferential surface at a position different from a position of the first contact portion, the second contact portion configured to contact to the restriction stopper when the operation tool is turned to the other direction.

Effects of the Invention

According to the present invention, the boom base portion includes: an inner side wall; and an outer side wall disposed opposite to the inner side wall, one end side of the lift link is inserted between the inner side wall and the outer side wall and is pivotally supported on the boom base portion. In this manner, a turning radius of a working machine can be reduced, and an enough space can be formed around the operator seat.

According to the present invention, the joint pipe joints the boom base portions to each other, and the joint pipe includes: a first wall; a second wall disposed in front of the first wall; a third wall configured to joint one end of the first wall and one end of the second wall to each other. The first wall is formed to have a shape curved toward the second wall, the second wall is formed to have a shape curved forward, and the more the first wall and the second wall separate from the third wall, the more the first wall and the second wall are close to each other. In this manner, a concentration of mechanical stress can be suppressed in the joint portion between the boom and the joint pipe.

In addition, the hydraulic hose is branched on the side of the front portion of the right boom or the left boom and being connected to the right hydraulic actuator and to the left hydraulic actuator, the hydraulic hose being configured to supply a hydraulic operation fluid to a hydraulic actuator for moving the operation tool. In this manner, a volume of the hydraulic hose lying on the joint pipe can be suppressed.

According to the present invention, the restriction stopper is disposed on a side of the inner wall of the front portion of the boom, the side being opposite to the outer wall, and the contact portion is disposed on the support plate, the support plate being disposed on a position corresponding to the restriction stopper, the position being opposite to the inner wall. In this manner, it can be prevented that the contact portion widely protrudes from the portion being attached to the contact portion as in the conventional technique, thereby reducing a load applied to the contact portion when the contact portion contacts the restriction stopper in the turning of the operation tool.

DESCRIPTION OF THE EMBODIMENTS

Referring to drawings, an embodiment of the present invention will be described below.

Figure 16:
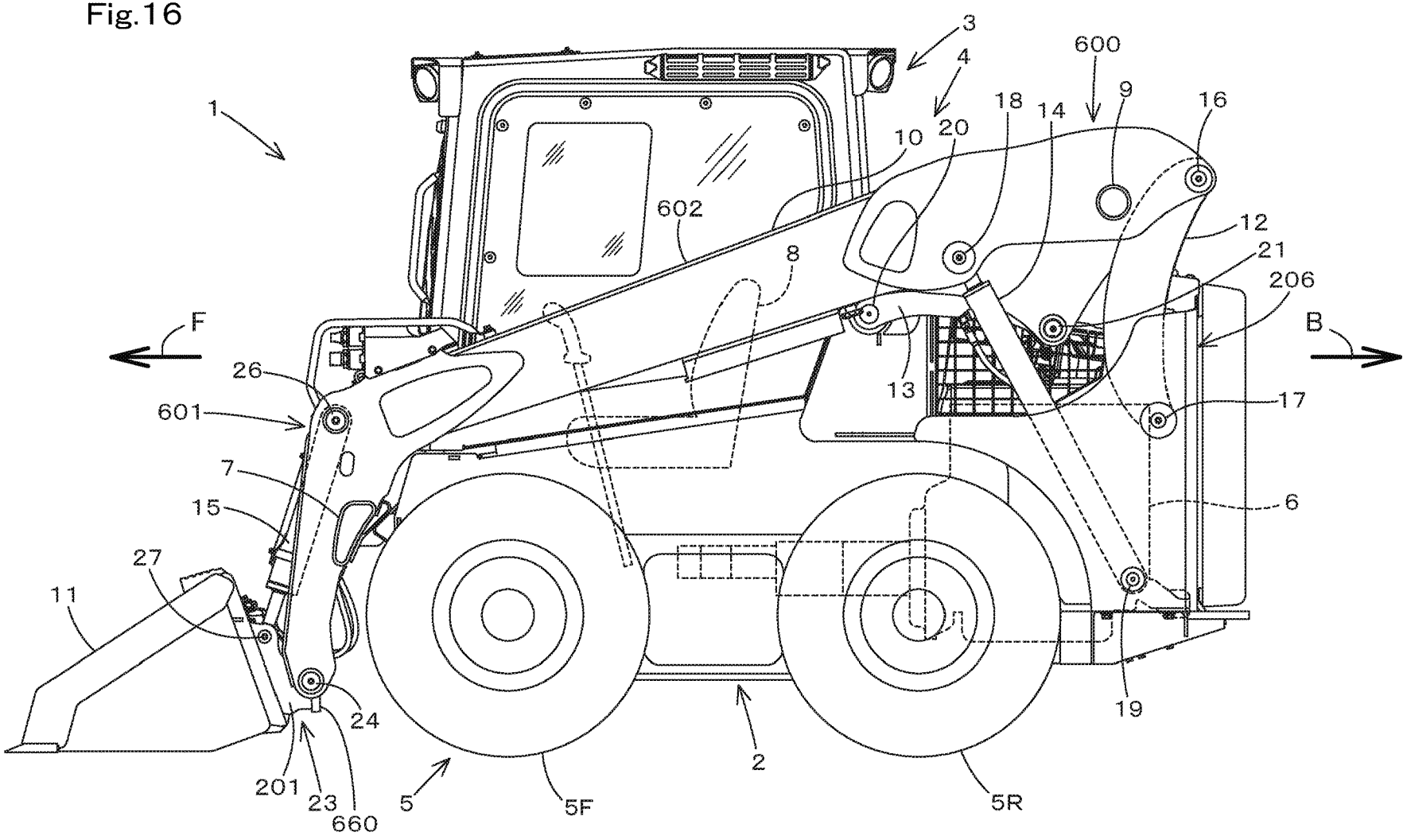
FIG. 16 is a side view of the working machine according to the embodiment of the present invention.
Figure 17:
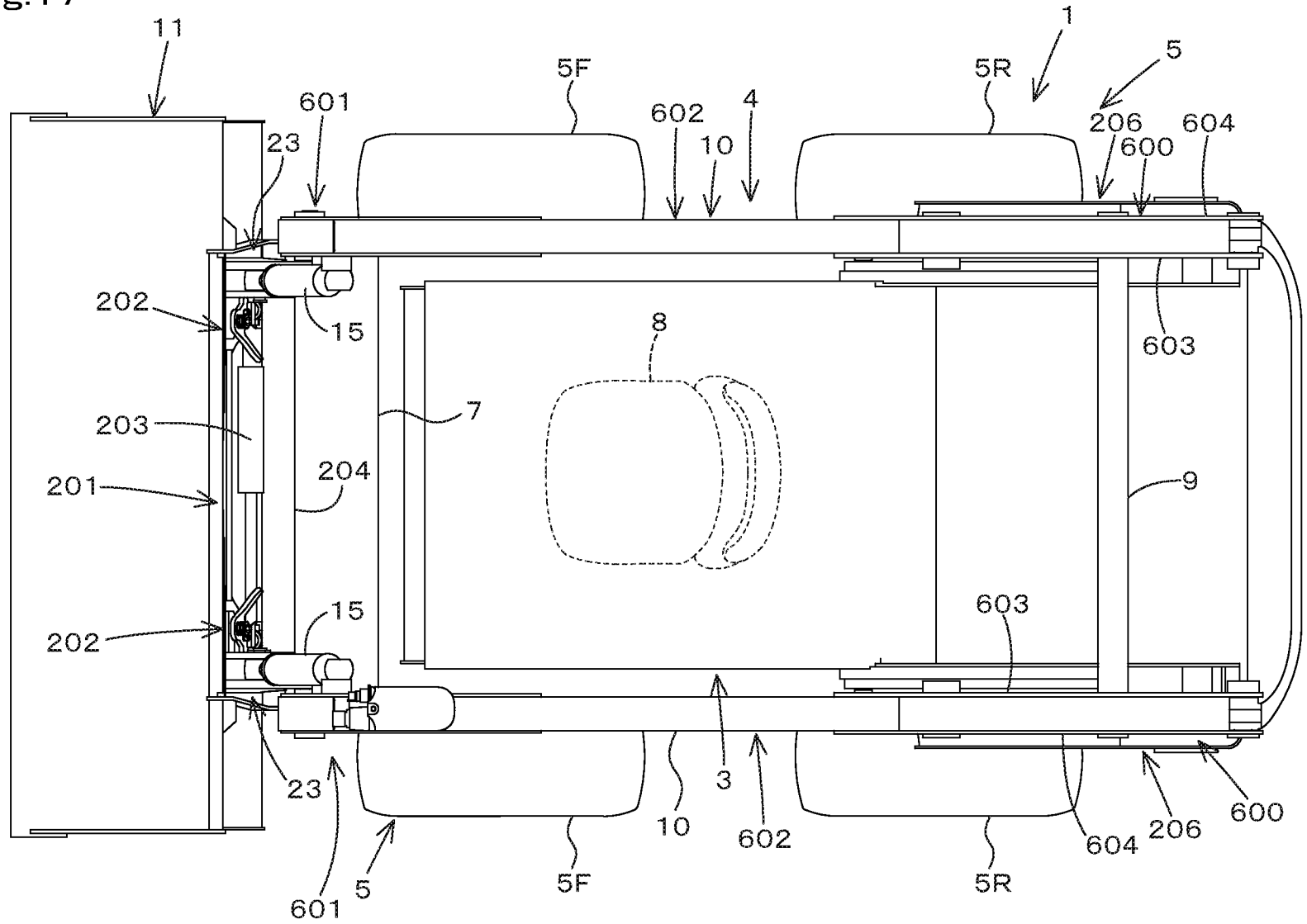
FIG. 17 is a plan view of the working machine according to the embodiment.
Figure 18:
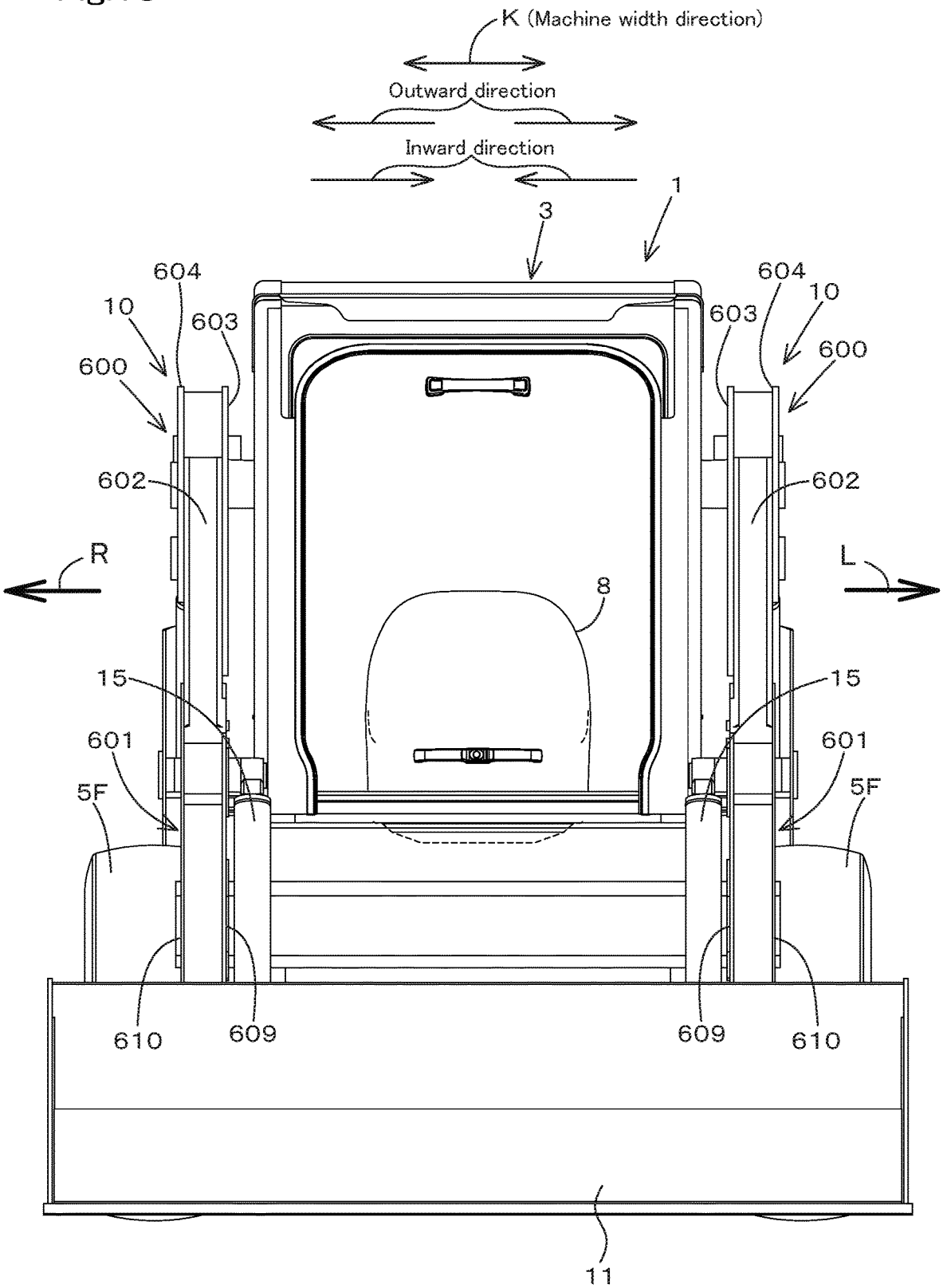
FIG. 18 is a front view of the working machine according to the embodiment.

FIG. 16 is a side view of a working machine 1 according to an embodiment of the present invention. FIG. 17 is a plan view of the working machine 1. FIG. 18 is a front view of the working machine 1.

FIG. 16 to FIG. 18 show a Skid Steer Loader (SSL) as an example of the working machine 1 according to the embodiment of the present invention. However, the working machine 1 of the present invention is not limited to the Skid Steer Loader (SSL), and can be other types of the working machine, for example, a Track Loader (TL), a Compact Track Loader (CTL), and the like.

The skid steer loader 1 is the working machine 1 according to the embodiment. The skid steer loader 1 includes a body 2 of the working machine (hereinafter referred to as a machine body 2), a cabin 3, an operation device 4, and travel devices 5.

The cabin 3 is mounted on the machine body 2. The operation device 4 is attached on the machine body 2. The skid steer loader 1 includes two travel devices 5; one of the travel devices 5 is provided on a right outside of the machine body 2, and the other one is provided on a left outside of the machine body 2.

A motor 6 is mounted on a rear portion of the machine body 2. The motor 6 is an engine, an electric motor, and the like. The skid steer loader 1 according to the embodiment employs a diesel engine. An operator seat 8 is disposed on a rear portion of the cabin 3.

Hereinafter, in explanations of the embodiment of the present invention and in explanations of the modified examples of the embodiment, a forward direction (a direction shown by an arrowed line F in FIG. 16) corresponds to a front side of an operator seating on the operator seat 8 of the skid steer loader 1, a backward direction (a direction shown by an arrowed line B in FIG. 16) corresponds to a back side of the operator, a leftward direction (a direction shown by an arrowed line L in FIG. 18) corresponds to a left side of the operator, and a rightward direction (a direction shown by an arrowed line R in FIG. 18) corresponds to a right side of the operator.

In addition, in explanations of the embodiment of the present invention and in explanations of the modified examples of the embodiment, a direction from the front side shown by the arrowed line F toward the back side shown by the arrowed line B (or a direction from the back side shown by the arrowed line B toward the front side shown by the arrowed line A) is referred to as a front to rear direction (or a rear to front direction), and a horizontal direction perpendicular to the front to rear direction (or the rear to front direction) is a direction K along a width of the machine body 2. The direction K along the width of the machine body 2 is hereinafter referred to as the machine width direction K. As shown in FIG. 18, in the following description, a direction from a center portion of the machine body 2 toward the above mentioned right side can be referred to as an outward direction. And, a direction from the center portion of the machine body 2 toward the above mentioned left side can be also referred to as the outward direction. The outward direction is hereinafter referred to as a machine outward direction. In other words, the machine outward direction corresponds to a direction departing from the center portion of the machine body 2 in the machine width direction K. A direction opposite to the machine outward direction can be referred to as an inward direction. The inward direction is hereinafter referred to as a machine inward direction. In other words, the machine inward direction corresponds to a direction toward the center portion of the machine body 2 in the machine width direction K.

As shown in FIG. 16 and FIG. 18, the operation device 4 includes booms 10, an operation tool 11, lift links 12, control links 13, boom cylinders 14, and bucket cylinders 15.

The operation device 4 includes two booms 10; one of the booms 10 is provided on a right side of the cabin 3 (referred to as the right boom 10) and is capable of freely swinging upward and downward, and the other one is provided on a left side of the cabin 3 (referred to as the left boom 10) and is capable of freely swinging upward and downward. The operation tool 11 is a bucket (hereinafter referred to as a bucket 11), for example. The bucket 11 is provided on tip portions (front end portions) of the booms 10 and is capable of freely swinging upward and downward. The lift link 12 and the control link 13 support a base portion (a rear portion) of the boom 10 so that the boom 10 is capable of freely swinging upward and downward. The boom cylinder 14 is capable of being stretched and shortened, thereby moving the boom 10 upward and downward. The bucket cylinder 15 is capable of being stretched and shortened, thereby swinging the bucket 11.

The operation device 4 includes a joint pipe 7 having a deformed shape, that is, the joint pipe 7 being a deformed pipe. The joint pipe 7 (a front joint pipe) is connected to a front portion of the right boom 10 and to a front portion of the left boom 10 between the right boom 10 and the left boom 10, thereby jointing the right boom 10 and the left boom 10 with each other. The operation device 4 includes a joint pipe 9 having a circular shape, that is, the joint pipe 7 being a circular pipe. The joint pipe 9 (a rear joint pipe) is connected to a base portion of the right boom 10 and to a base portion of the left boom 10 between the right boom 10 and the left boom 10, thereby jointing the right boom 10 and the left boom 10 with each other.

The operation device 4 includes two lift links 12, two control links 13, and two boom cylinders 14. One of the lift links 12 (the right lift link 12), one of the control links 13 (the right control link 13), and one of the boom cylinders 14 (the right boom cylinder 14) are provided on a right side of the machine body 2, corresponding to the right boom 10 (also referred to as the corresponding boom 10). And, the other one of the lift links 12 (the left lift link 12), the other one of the control links 13 (the left control link 13), and the other one of the boom cylinders 14 (the left boom cylinder 14) are provided on a left side of the machine body 2, corresponding to the left boom 10 (also referred to as the corresponding boom 10).

The lift link 12 is vertically provided on a rear portion of the base portion of the boom 10. The lift link 12 is supported at an upper portion (one end side) of the lift link 12 by a pivot shaft 16 (a first pivot shaft) to be capable of freely turning around a horizontal axis of the pivot shaft 16, the lift link 12 being supported on the rear portion of the base portion of the boom 10 by the pivot shaft 16. In addition, the lift link 12 is supported at a lower portion (the other end side) of the lift link 12 by a pivot shaft 17 (a second pivot shaft) to be capable of freely turning around a horizontal axis of the pivot shaft 17, the lift link 12 being supported on the rear portion of the machine body 2 by the pivot shaft 16. The second pivot shaft 17 is disposed lower than the first pivot shaft 16.

The boom cylinder 14 is supported at an upper portion (one end side) of the boom cylinder 14 by a pivot shaft 18 (a third pivot shaft) to be capable of freely turning around a horizontal axis of the pivot shaft 18. The third pivot shaft 18 is disposed on the base portion of the boom 10 in front of the first pivot shaft 16. The boom cylinder 14 is supported at a lower portion (the other end) of the boom cylinder 14 by a pivot shaft 19 (a fourth pivot shaft) to be capable of freely turning around a horizontal axis of the pivot shaft 19. The fourth pivot shaft 19 is disposed on a lower portion of the rear portion of the machine body 2, being lower than the third pivot shaft 16.

The control link 13 is disposed in front of the lift link 12. One end of the control link 13 is supported by a pivot shaft 20 (a fifth pivot shaft) to be capable of freely turning around a horizontal axis of the pivot shaft 20. The fifth pivot shaft 20 is disposed on the machine body 2. The other end of the control link 13 is supported by a pivot shaft 21 (a sixth pivot shaft) to be capable of freely turning around a horizontal axis of the pivot shaft 21. The sixth pivot shaft 21 is disposed on the boom 10 in front of the second pivot shaft 17, being higher than the second pivot shaft 17.

Stretching and shortening of the boom cylinder 14 swing the boom 10 upward and downward around the first pivot shafts 16, the boom 10 being supported on the base portion of the boom 10 by the lift link 12 and the control link 13, thereby moving a tip portion of the boom 10 upward and down ward. The control link 13 is swung upward and downward around the fifth pivot shaft 20 by the swinging upward and downward of the boom 10. The lift link 12 is swung forward and backward around the second pivot shaft 17 by the swinging upward and downward of the control link 13.

As shown in FIG. 16 and FIG. 17, an attachment device 201 is disposed on each of the front portions (the tip portions) of the booms 10. The bucket 11 is capable of being attached to and detached from the attachment device 201. The attachment device 201 includes an attachment body 23, a lock mechanism 202, and a lock cylinder 203. A pivot pin 24 is disposed on each of the front portions of the booms 10, and an attachment body 23 is pivotally supported on the front portions (the tip portions) of the booms 10. The attachment body 23 disposed on the right side is jointed to the attachment body 23 disposed on the left side by a joint member 204. The lock mechanism 202 prevents the bucket 11 from being detached from the attachment body 23.

The lock cylinder 203 moves the lock mechanism 202, thereby turning the lock mechanism 202 into a locking operation state or into a lock-releasing operation state. The lock cylinder 203 is constituted of a double action hydraulic cylinder.

Not only the bucket 11, other operation tools can be attached to the attachment device 201. The following attachments (spare attachments) are exemplified as the other operation tools; for example, a hydraulic crusher, a hydraulic breaker, an angle broom, an earth auger, a pallet fork, a sweeper, a mower, a snow blower, and the like.

The bucket cylinder 15 is arranged closer to the front portion of each of the booms 10. The bucket cylinder 15 is pivotally supported on the boom 10 by a first bucket cylinder pin 26 at an upper portion of the bucket cylinder 15, thereby being capable of freely turning about a horizontal axis of the first bucket cylinder pin 26. The bucket cylinder 15 is pivotally supported on the attachment body 23 by a second bucket cylinder pin 27 at a lower portion of the bucket cylinder 15, thereby being capable of freely turning about a horizontal axis of the second bucket cylinder pin 27. Stretching and shortening of the bucket cylinder 15 swing the bucket 11.

In the embodiment, both of the right travel device 5 and the left travel device 5 employ a wheeled travel device, the wheeled travel device having a front wheel 5F and a rear wheel 5R. However, a crawler travel device including a semi-crawler travel device) may be employed as the travel device 5.

Next, a concrete configuration of the steer skid loader 1 will be described below.

Figure 1:
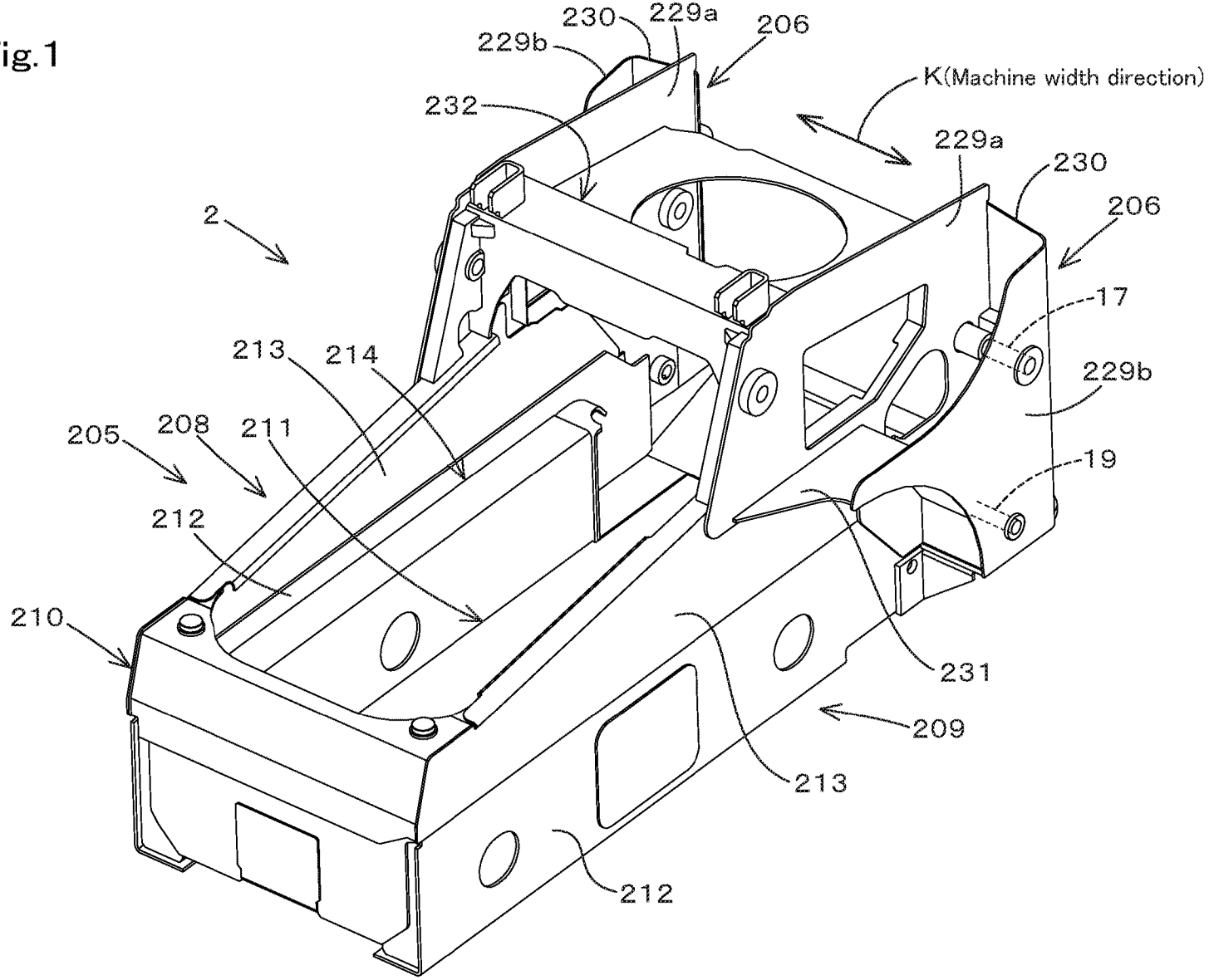
FIG. 1 is a perspective view showing a machine body according to an embodiment of the present invention, seen diagonally-backward from a front of the working machine according to the embodiment of the present invention.
Figure 2:
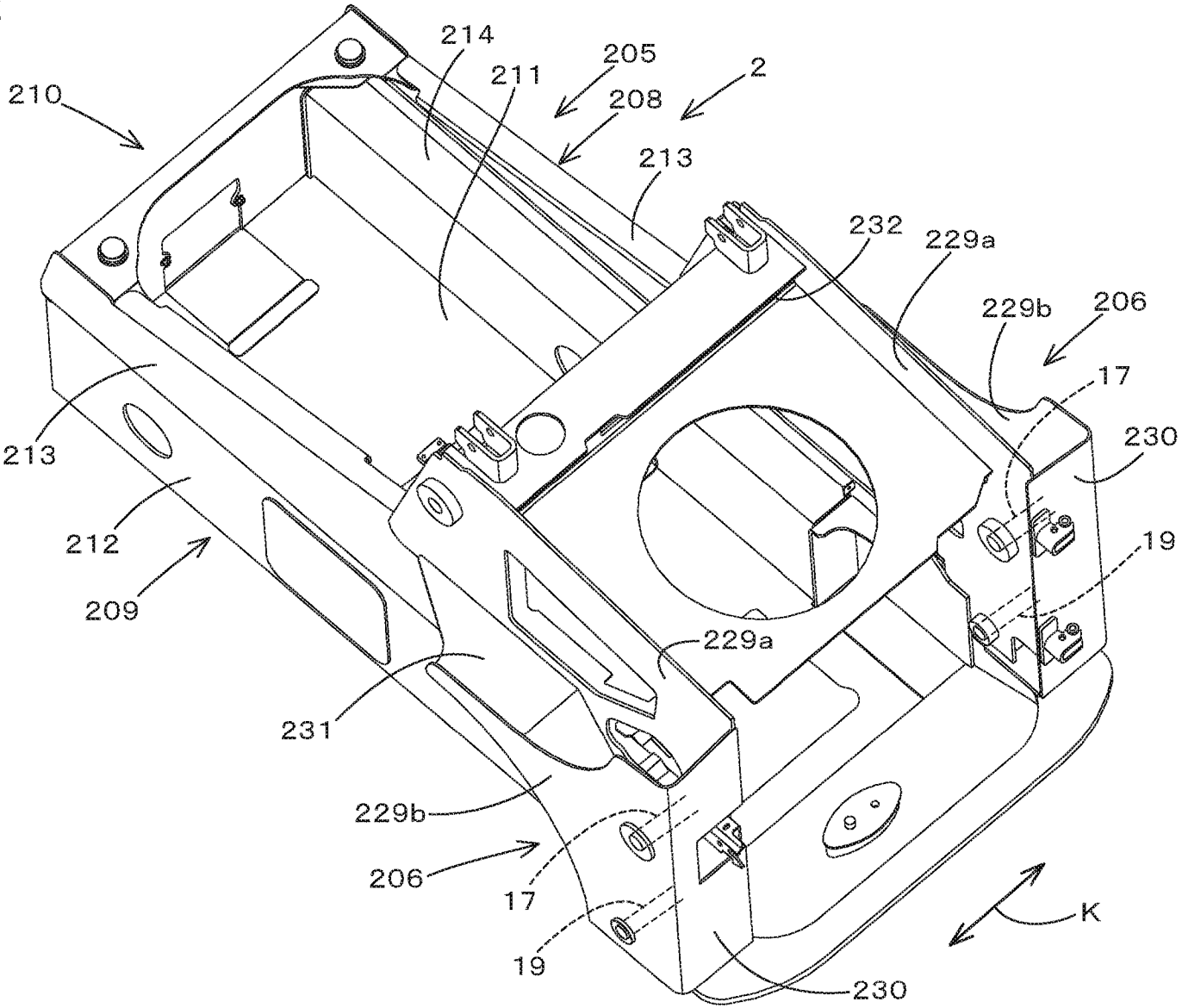
FIG. 2 is a perspective view showing the machine body according to the embodiment, seen diagonally-forward from behind the working machine.

As shown in FIG. 1 and FIG. 2, the machine body 2 includes a main frame 205, a support frame 206, and a joint frame 232.

Figure 3:
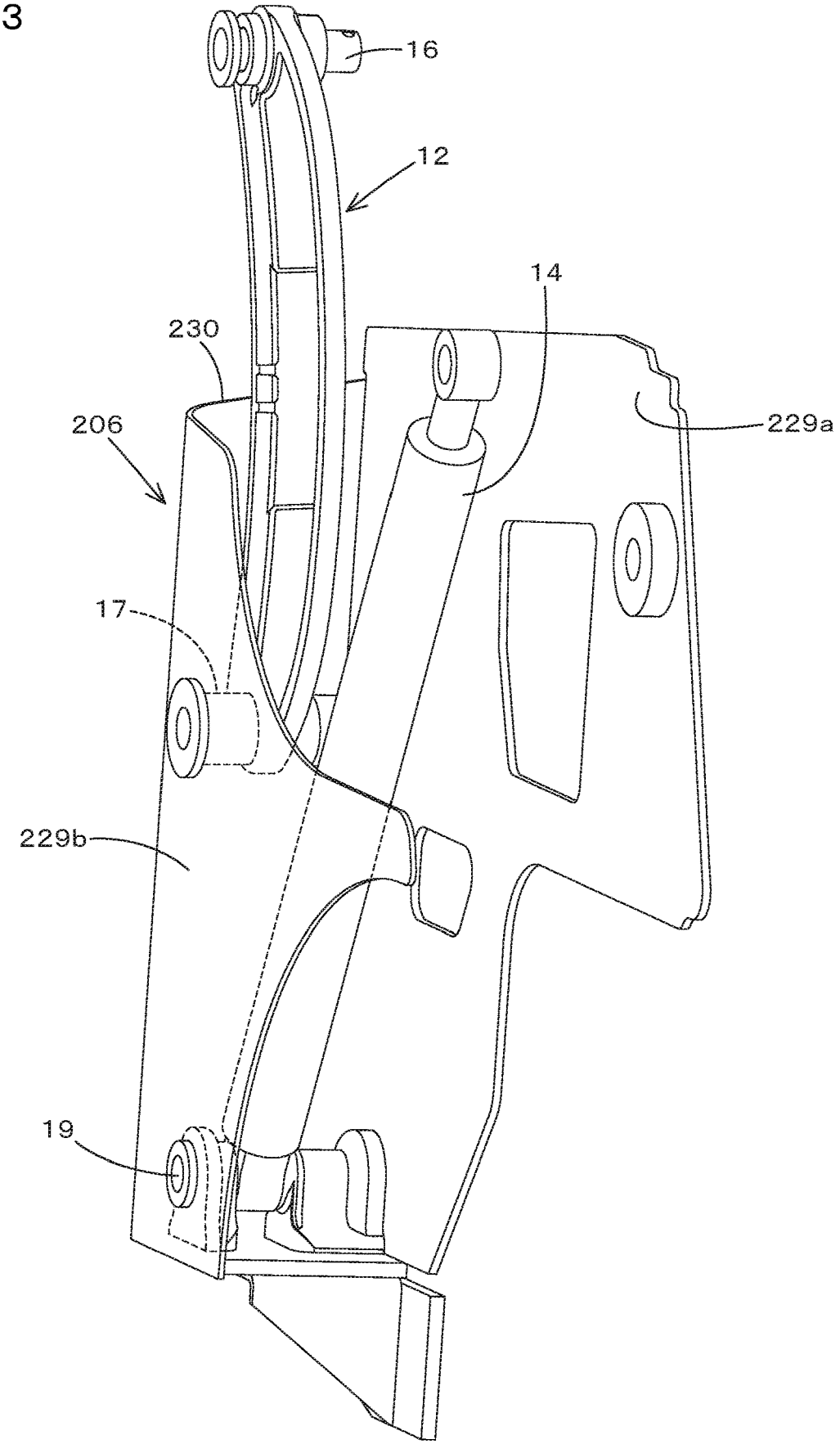
FIG. 3 is a perspective view showing arrangements of a lift link and a boom cylinder according to the embodiment, seen from the front of the working machine.

The main frame 205 includes a right frame portion 208, a left frame portion 209, a front frame portion 210, and a bottom frame portion 211. The right frame portion 208 constitutes a right portion of the machine body 2. The left frame portion 209 constitutes a left portion of the machine body 2. The front frame 210 constitutes a front portion of the machine body 2. The bottom frame portion 211 constitutes a bottom portion of the machine body 2. As shown in FIG. 3, the right frame portion 208 and the left frame portion 209 each include a side member 212, an upper plate member 213, and a cover 214.

As shown in FIG. 1 and FIG. 2, one of the support frames 206 is disposed on a right side of a rear portion of the main frame 205, and the other one of the support frames 206 is disposed on a left side of the rear portion of the main frame 205.

Each of the support frames 206 includes: a pair of a support wall 229*a* and a support wall 229*b*; and a rear wall 230. One of the support walls, the support wall 229*a*, is separated from the other one of the support walls, the support wall 229*b*, in the machine width direction K. The support wall 229*a* and the support wall 229*b* are disposed to be opposite to each other.

Of the pair of support wall 229*a* and 229*b*, the support wall 229*a* (also referred to as the inner support wall 229*a*) is fixed to the upper plate member 213. The support wall 229*b* (also referred to as the outer support wall 229*b*) is placed outside the inner support wall 229*a*.

The rear wall 230 is jointed to a rear end of the support wall 229*a* and to a rear end of the support wall 229*b*, thereby jointing the support wall 229*a* and the support wall 229*b* to each other. A fender 231 is disposed between the pair of support walls 229*a* and 229*b*, the fender 231 being configured to cover the rear wheel 5R at a back and upper side of the rear wheel 5R. A joint frame 232 is disposed between the support frames 206. The joint frame 232 joints the joint frames 232 to each other.

As shown in FIG. 3, a lower portion of the lift link 12 disposed on the right side is inserted between the support wall 229*a* and the support wall 229*b*, the support wall 229*a* and the support wall 229*b* being included in the support frame 206 disposed on the right side. In the same manner described above, a lower portion of the lift link 12 disposed on the left side is inserted between the support wall 229*a* and the support wall 229*b*, the support wall 229*a* and the support wall 229*b* being included in the support frame 206 disposed on the left side. In particular, of the pair of the support walls

229*a* and 229*b* of the support frame 206, one of the support walls 229*a* and 229*b* is positioned on one side of a lower portion of the lift link 12, and the other one of the support walls 229*a* and 229*b* is positioned on the other side of the lower portion of the lift link 12.

The second pivot shaft 17 is disposed extending over between the pair of the support walls 229*a* and 229*b*, the second pivot shaft 17 pivotally supporting the lower portion of the lift link 12.

As shown in FIG. 3, a lower portion of the boom cylinder 14 disposed on the right side is inserted between the support wall 229*a* and the support wall 229*b*, the support wall 229*a* and the support wall 229*b* being included in the support frame 206 disposed on the right side. In the same manner described above, a lower portion of the boom cylinder 14 disposed on the left side is inserted between the support wall 229*a* and the support wall 229*b*, the support wall 229*a* and the support wall 229*b* being included in the support frame 206 disposed on the left side. In particular, of the pair of the support walls 229*a* and 229*b* of the support frame 206, one of the support walls 229*a* and 229*b* is positioned on one side of a lower portion of the boom cylinder 14, and the other one of the support walls 229*a* and 229*b* is positioned on the other side of the lower portion of the boom cylinder 14.

The fourth pivot shaft 19 is disposed extending over between the pair of the support walls 229*a* and 229*b*, the fourth pivot shaft 19 pivotally supporting the boom cylinder 14.

Figure 4:
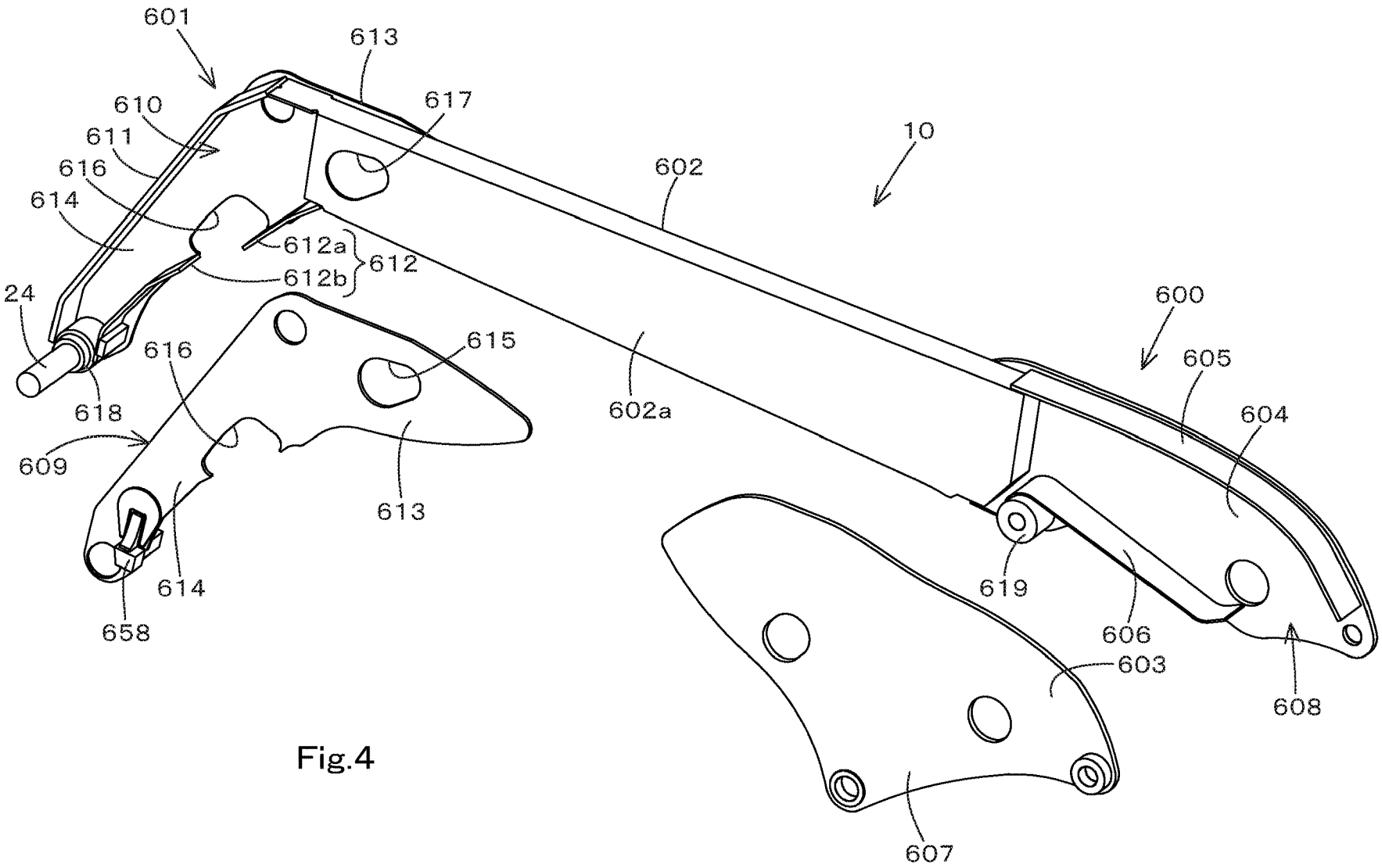
FIG. 4 is an exploded perspective view of the boom according to the embodiment.

Referring to FIG. 4, a structure of the boom 10 will be explained below. FIG. 4 shows the boom 10 disposed on the right side. The boom. 10 disposed on the right side has the same configuration as a configuration of the boom 10 disposed on the left side in main components.

As shown in FIG. 4, the boom 10 includes a boom base portion 600, a boom front portion 601, and a boom intermediate portion 602. The boom base portion 600 constitutes a rear portion of the boom 10, and is disposed on a position corresponding to a rear portion of the machine body 2. The boom front portion 601 constitutes a front portion of the boom 10, and is disposed on a side close to a front portion of the machine body 2. The boom intermediate portion 602 constitutes an intermediate portion between the boom base portion 600 and the boom front portion 601, and joints the boom base portion 600 and the boom front portion 601 to each other.

The boom base portion 600 includes an inner side wall 603, an outer side wall 604, an upper joint wall 605, and a lower joint wall 606. The inner side wall 603 and the outer side wall 604 are disposed opposite to each other in the machine width direction K. The outer side wall 604 is positioned outside the inner side wall 603 in the machine outward direction.

An extending portion 607 is disposed on a lower portion of the inner side wall 603, the extending portion 607 protruding downward. A rear portion of the control link 13 is pivotally supported on a lower portion of the extending portion 607 by the sixth pivot shaft 21. The upper joint wall 605 joints an upper portion of the inner side wall 603 to an upper portion of the outer side wall 604. The lower joint wall 606 joints a lower portion of the inner side wall 603 to a lower portion of the outer side wall 604.

A hose inlet 608 is formed as a space between a rear end of the upper joint wall 605 and a rear end of the lower joint wall 606, the hose inlet 608 being used for inserting a hydraulic hose into the boom 10.

The boom front portion 601 includes an inner wall 609, an outer wall 610, a front joint wall 611, and a rear joint wall 612. The inner wall 609 and the outer wall 610 are disposed opposite to each other in the machine width direction K. The outer wall 610 is positioned outside the inner wall 609 in the machine outward direction.

The inner wall 609 and the outer wall 610 each include a first portion 613 and a second portion 614. The second portion 614 is extended downward from a front portion of the first portion 613. An intermediate portion of the inner wall 609 in a longitudinal direction bends in a side view. An intermediate portion of the outer wall 610 in a longitudinal direction bends in a side view. A rim portion is formed on the first portion 613 of the inner wall 609, the rim portion having a circular shape to form a through hole 615.

An insertion concave portion 616 is formed on the second portion 614 of the inner wall 609. Another insertion concave portion 616 is formed on the second portion 614 of the outer wall 610. The front joint pipe 7 is inserted into the insertion concave portions 616.

The front joint wall 611 joints front portions of the second portions 614 to each other, one of the second portions 614 being included in the inner wall 609, the other one of the second portions 614 being included in the outer wall 610.

The rear joint wall 612 includes a first member 612*a* and a second member 612*b*. The first member 612*a* is positioned behind the insertion concave portion 616. The second member 612*b* is positioned in front of the insertion concave portion 616. The first member 612*a* and the second member 612*b* joint a rear portions of the second portions 614 to each other; one of the second portions 614 being included in the inner wall 609, the other one of the second portions 614 being included in the outer wall 610.

The boom intermediate portion 602 is formed to have a cylindrical shape at a front end of the boom intermediate portion 602 and at a rear end thereof. A rear portion of the boom intermediate portion 602 is inserted between the inner side wall 603 and the outer side wall 604 and is fixed to the inner side wall 603 and the outer side wall 604, the inner side wall 603 and the outer side wall 604 being included in the boom base portion 600. A front portion of the boom intermediate portion 602 is inserted between the inner wall 609 and the outer wall 610 and is fixed to the inner wall 609 and the outer wall 610, the inner wall 609 and the outer wall 610 being included in the boom front portion 601.

A hose outlet 617 is formed on a front portion of a wall portion 602*a* disposed inside the boom intermediate portion 602, the hose outlet 617 being communicated with the through hole 615.

A boss portion 618 (referred to as a tip end boss) is disposed on a lower end of the boom front portion 601 (on a tip end portion of the boom 10) between the inner wall 609 and the outer wall 610, that is, between the front joint wall 611 and the rear joint wall 612. The pivot pin 24 is fixed to the tip end boss 618, the pivot pin 24 being configured to pivotally support the attachment body 23. The pivot pin 24 protrudes from the tip end boss 618 toward the machine inward direction.

Figure 5:
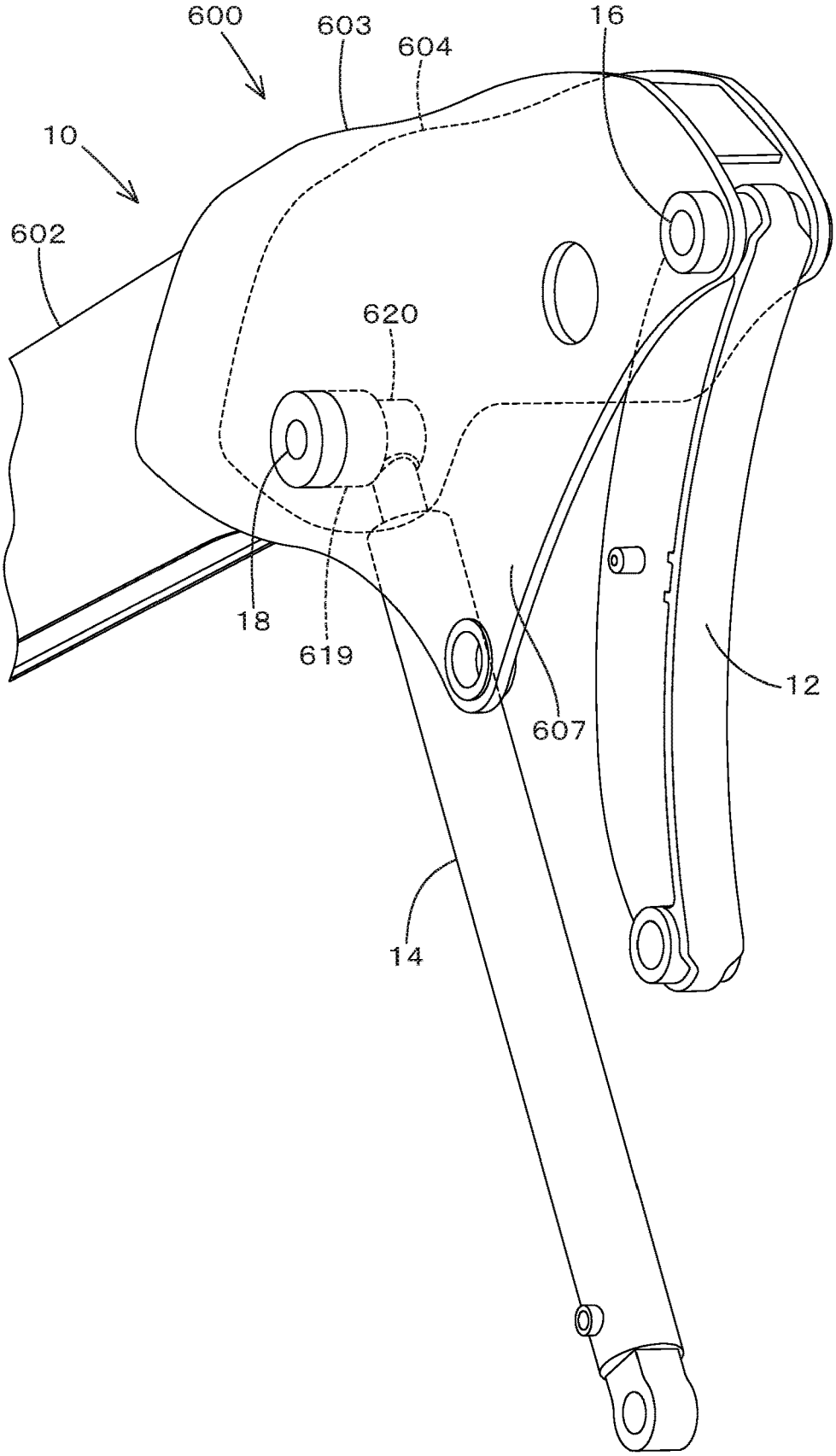
FIG. 5 is a perspective view showing an attachment portion of upper portions of the lift link and the boom cylinder according to the embodiment, seen from the back of the working machine.

As shown in FIG. 5, the lift link 12 is constituted of a plate member. An upper portion of the lift link 12 is inserted to a rear portion of the boom base portion 600 between the inner side wall 603 and the outer side wall 604. A first pivot shaft 16 is inserted to the inner side wall 603, the outer side wall 604, and the lift link 12. The first pivot shaft 16 pivotally supports the inner side wall 603, the outer side wall 604, and the lift link 12.

As shown in FIG. 5, an upper portion of the boom cylinder 14 is inserted to a front portion of the boom base portion 600 between the inner side wall 603 and the outer side wall 604. A support boss 619 is disposed on a front portion of the inner side wall 603. A pivot portion 620 is arranged between the support boss 619 and the outer side wall 604, the pivot portion 620 being disposed on an upper end of the boom cylinder 14.

The third pivot shaft 18 is inserted to the support boss 619, the outer side wall 604, and the pivot portion 620 of the boom cylinder 14. In this manner, the pivot portion 620 of the boom cylinder 14 is pivotally supported by the boom base portion 600.

Meanwhile, for enlargement of a width of the cabin 3 (a space around the operator seat 8), the steer skid loader 1 is required to enlarge an interval between the booms 10 as large as possible. In addition, the support frame 206 (a corner portion between the rear wall 230 and the support wall 229*b*) restricts reduction of the turning radius especially when the machine body 2 turns. The turning radius can be reduced by reducing an interval between the support wall 229*b* disposed on the right side and the support wall 229*b* disposed on the left side (an interval between outside surfaces of lower portions of the lift links 12).

A conventional lift link includes an inner side plate and an outer side plate. A rear portion of the boom base portion 600 is inserted between the inner side plate and the outer side plate. In the conventional technique, a width of a lower portion of the lift link is smaller than a width of an upper portion of the lift link (the interval between the inner side wall and the outer side wall) in order to keep the interval between the booms 10 large and to reduce the interval between the outside surface of the lift link disposed on the right side and the outside surface of the lift link disposed on the left side. In particular, the interval between: the lower portion of the lift link disposed on the right side; and the lower portion of the lift link disposed on the left side is smaller than the interval between: the upper portion of the lift link disposed on the right side; and the upper portion of the lift link disposed on the left side. Thus, a position of load applied to one end of the lift link is not in a straight line with a position of load applied to the other end of the lift link, and accordingly the lift link has to have a high bending rigidity and a high torsional rigidity. As a result, the lift link will have a heavy weight accordingly.

Figure 6:
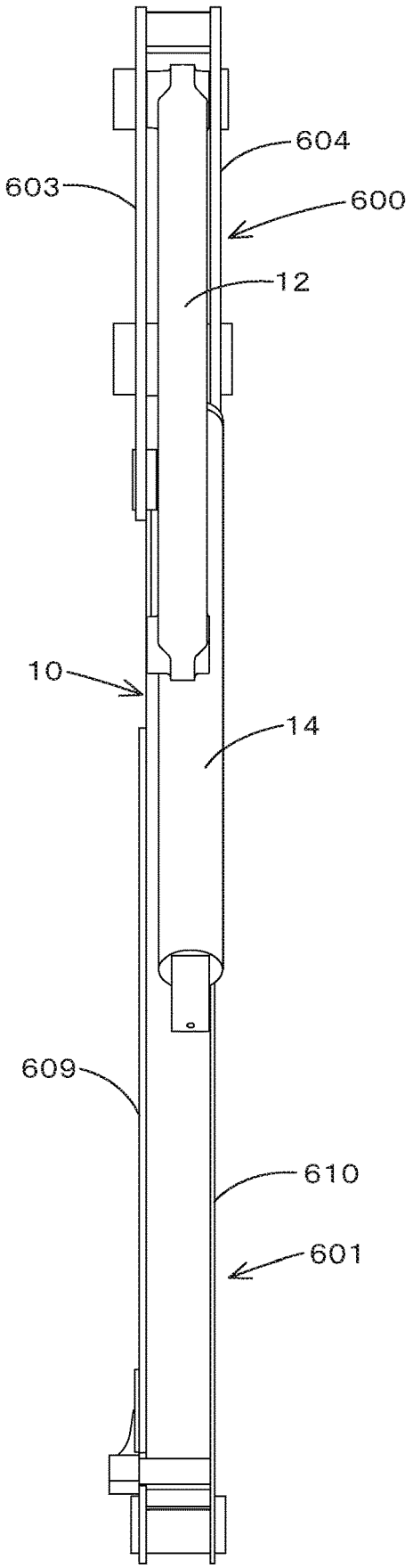
FIG. 6 is a back view of the boom, the lift link, and the boom cylinder according to the embodiment.

On the other hand, in the steer skid loader 1 (the working machine 1), an upper portion of the lift link 12 is inserted to the boom base portion 600 between the inner side wall 603 and the outer side wall 604 as shown in FIG. 5 and FIG. 6. In this manner, the boom 10, the lift link 12, and the boom cylinder 14 can be arranged in approximately one line when seen from a back surface of the steer skid loader 1. As a result, a position of load applied to one end of the lift link can be prevented from being not in a straight line with a position of load applied to the other end of the lift link 12. In addition, a width between outer surfaces of a lower portion of the lift link 12 can be reduced keeping the interval between the booms 10 large. Moreover, since a position of load applied to one end of the lift link 12 can be prevented from being not in a straight line with a position of load applied to the other end of the lift link, the pivotally supporting portion between the lift link 12 and the boom base portion 600 can be configured by a simple structure, the pivotally supporting portion between the lift link 12 and the support frame 206 can be configured by a simple structure, and thus the weight of the supporting structure can be reduced.

Figure 7:
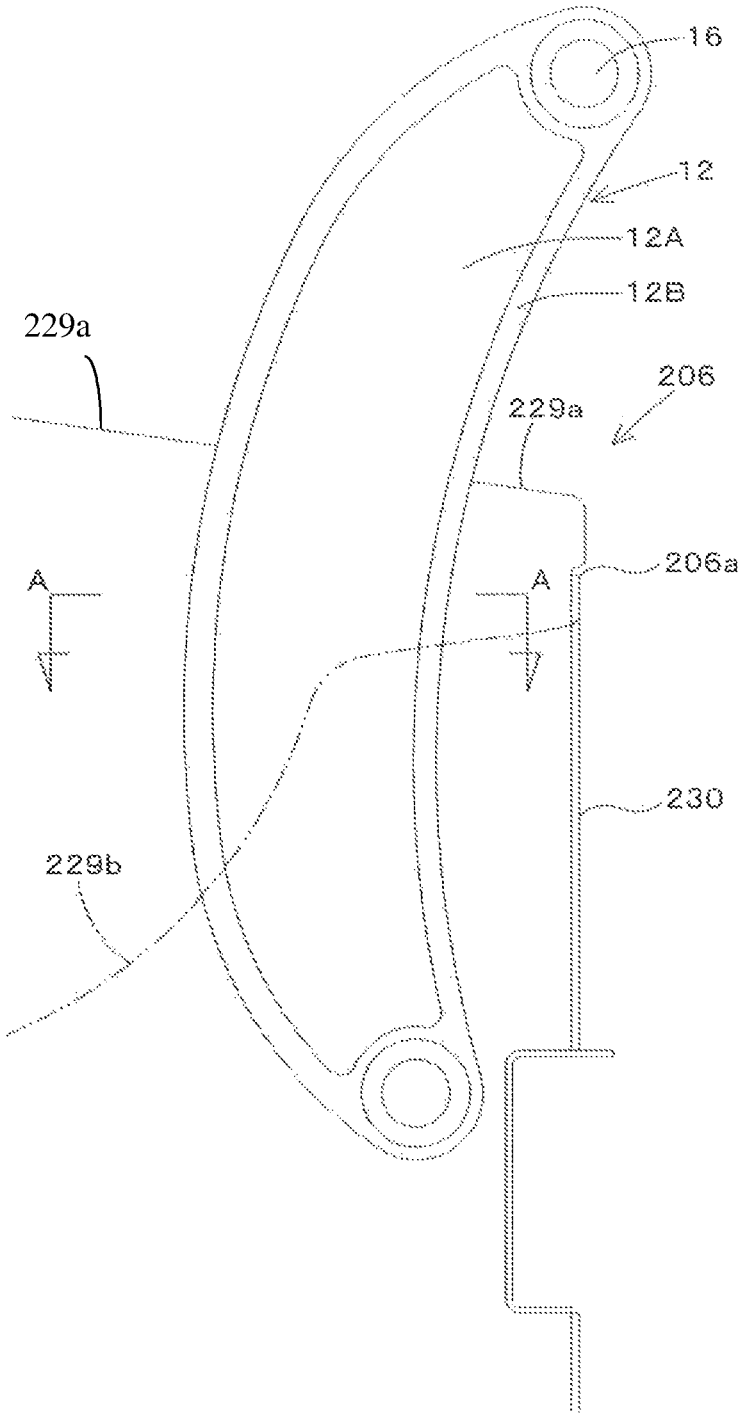
FIG. 7 is a side view of the arrangement of the lift link according to the embodiment.

As shown in FIG. 7, the lift link 12 is formed to have a curved shape protruding a center portion of the curved shape in a longitudinal direction forward when seen from a side. In addition, the lift link 12 swings centering about the second pivot shaft 17 when the boom 10 is swung upward and downward. In this manner, the lift link 12 is separated backward from the boom cylinder 14, thus the lift link 12 can be prevented from hitting the boom cylinder 14 certainly, and further the lift link 12 can be prevented from hitting an upper end 206*a* of the rear wall 230 of the support frame 206. Moreover, a rear side of the lift link 12 is widely captured in a sight from the operator seat 8 (a sight seen diagonally-backward from the operator seat 8 is wide).

Figure 8:
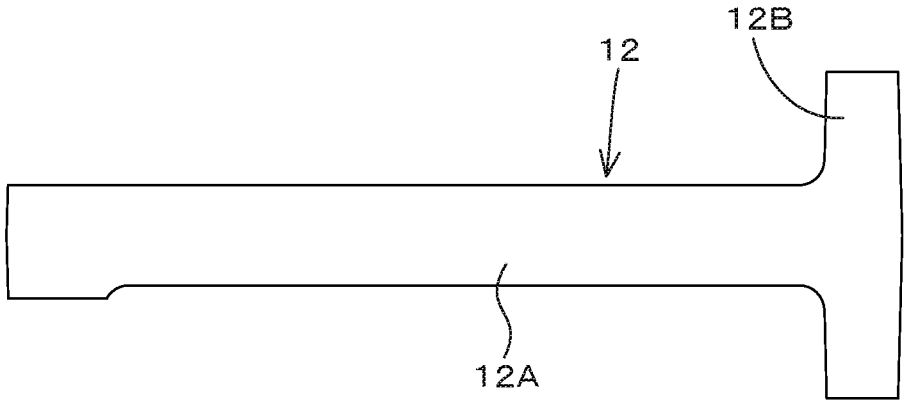
FIG. 8 is a cross-sectional view along an A-A arrowed lines in FIG. 7.

As shown in FIG. 5 and FIG. 8, the lift link 12 includes: a main wall portion 12A vertically extending; and a protruding portion 12B protruding from the main wall portion 12A. The protruding portion 12B protrudes rightward and leftward from a rear portion of the main wall portion 12A. The protruding portion 12B is formed extending from an upper end of the main wall portion 12A to a lower end of the main wall portion 12A. The lift link 12 has an approximately T-shaped cross section when seen in a horizontal direction, the T-shaped cross section being formed of the main wall portion 12A and the protruding portion 12B. In this manner, a torsional rigidity of the lift link 12 is secured.

Figure 9:
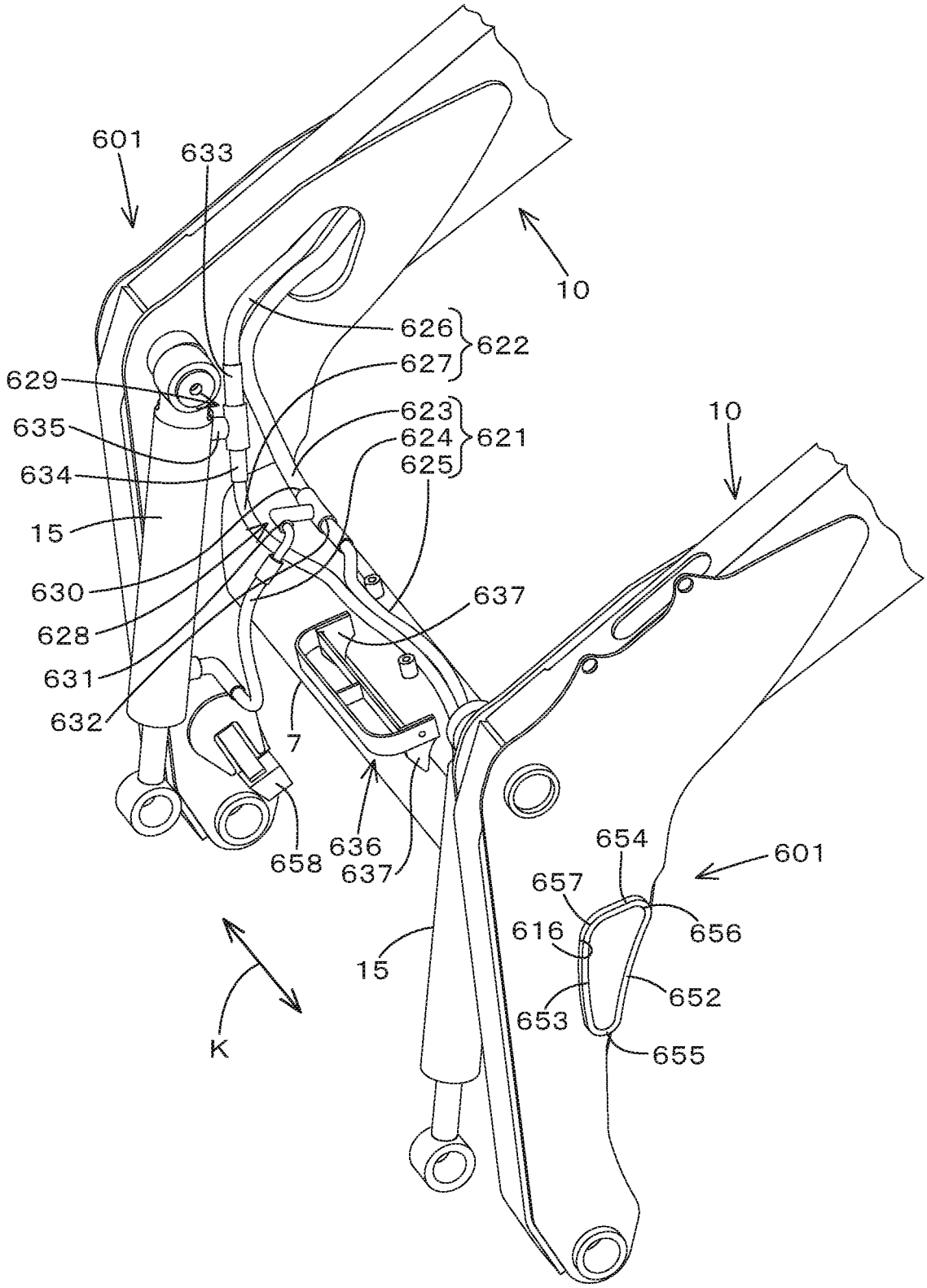
FIG. 9 is a perspective view of a front portion of an operation device according to the embodiment.

As shown in FIG. 9, bucket hydraulic hoses 621 and 622 are disposed between the boom front portions 601, the bucket hydraulic hoses 621 and 622 being used for supplying a hydraulic operation fluid to the bucket cylinder 15. The bucket hydraulic hose 621 serves as a bottom hose 621, and the bucket hydraulic hose 622 serves as a rod hose 622. The rod hose 621 is a hose used for supplying a hydraulic operation fluid to a side of a rod of the bucket cylinder 15. The bottom hose 622 is a hose used for supplying a hydraulic operation fluid to a side of a bottom of the bucket cylinder 15.

The rod hose 621 includes a first hose 623, a second hose 624, and a third hose 625. The bottom hose 622 includes a fourth hose 626 and a fifth hose 627.

The first hose 623 and the fourth hose 626 are inserted to the hose inlet 608 of the boom base portion 600 disposed on the right side, are internally disposed in the boom 10 disposed on the right side, and are withdrawn to the outside through the hose outlet 617 and the through hole 615. In addition, a first branching member 628 and a second branching member 629 are disposed right between the boom front portions 601. The first branching member 628 includes a first connecting portion 630, a second connecting portion 631, and a third connecting portion 632.

The first hose 623 is connected to the first connecting portion 630, the second hose 624 is connected to the second connecting portion 631, and the third hose 625 is connected to the third connecting portion 632. The second hose 624 is connected to a side of a rod of the bucket cylinder 15 disposed on the right side. The third hose 625 is connected to a side of a rod of the bucket cylinder 15 disposed on the left side.

The second branching member 629 includes a fourth connecting portion 633, a fifth connecting portion 634, and a sixth connecting portion 635. The fourth hose 626 is connected to the fourth connecting portion 633, the fifth hose 627 is connected to the fifth connecting portion 634, and the sixth connecting portion 635 is connected to a side of a bottom of the bucket cylinder 15 disposed on the right side. The fifth hose 627 is connected to a side of a bottom of the bucket cylinder 15 disposed on the left side. The third hose 625 and the fifth hose 627 are arranged on and along the front joint pipe 7.

Meanwhile, the first hose 623 and the fourth hose 626 may be internally disposed in the boom 10 disposed on the left side. In this case, the first branching member 628 and the second branching member 629 are disposed, between the boom front portions 601, being closer to the boom 10 disposed on the left side.

A conventional technique arranges both of a rod hose and a bottom hose on the front joint pipe 7, the bottom hose being connected to the side of the bottom of the bucket cylinder 15. And, the bottom hose is branched on the front joint pipe 7, and then the branched first hydraulic hose is connected to the side of the bottom of the bucket cylinder 15. On the other hand, the embodiment of the present invention branches the bottom hose on the front portion of the boom 10, the front portion being close to the bottom of the bucket cylinder 15, and connects the branched first hydraulic hose to the side of the bottom of the bucket cylinder 15. In this manner, the number of hydraulic hoses lying on the front joint pipe 7 can be reduced, and thereby the volume of the hydraulic hoses can be reduced on the front joint pipe 7.

Figure 10:
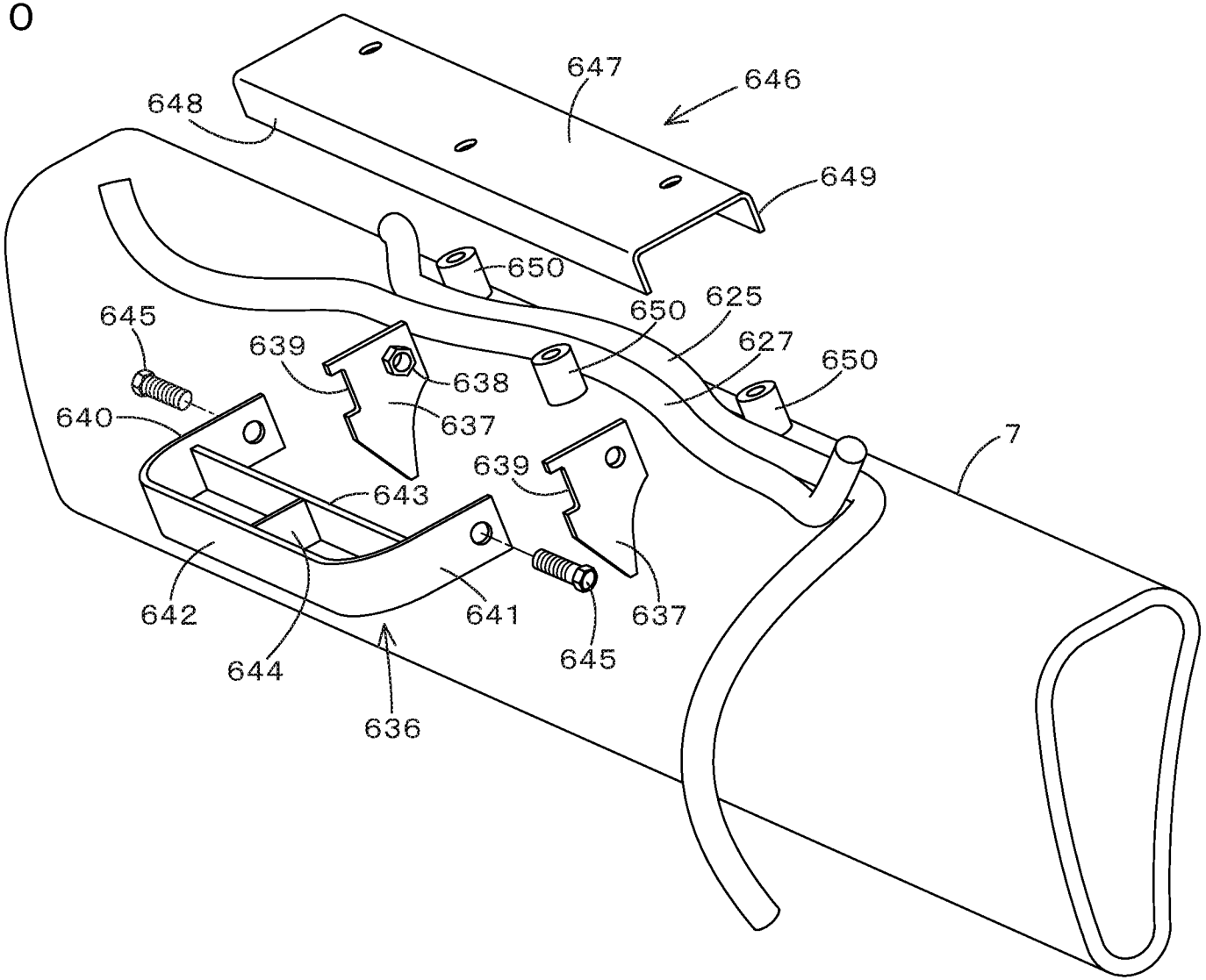
FIG. 10 is an exploded perspective view of a boarding step and a hose cover according to the embodiment.
Figure 11:
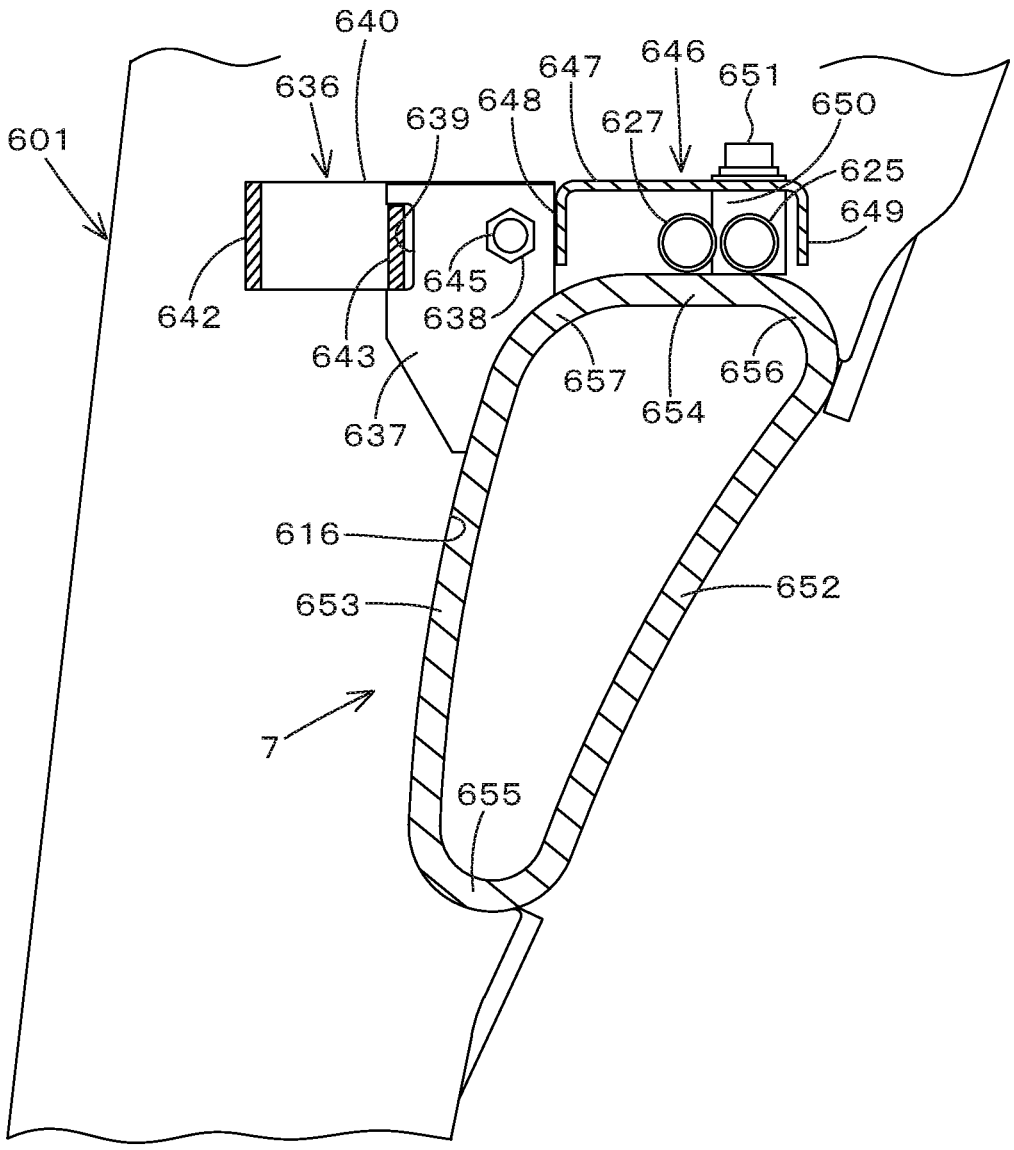
FIG. 11 is a cross-sectional side view showing arrangements of the boarding step and the hose cover according to the embodiment.

As shown in FIG. 9, FIG. 10, and FIG. 11, a boarding step 636 is disposed on the front portion of the front joint pipe 7. The boarding step 636 is a member that an operator steps in getting on the cabin 3 and in getting off the cabin 3.

The boarding step 636 is attached to a bracket 637 disposed on a front upper portion of the front joint pipe 7. The bracket 637 is formed of a plate member, and a pair of the brackets 637 is disposed on the front upper portion of the front joint pipe 7. The pair of the brackets 637 are each disposed being opposite to each other in the machine width direction K. A nut 638 is disposed on each of surfaces (opposite surfaces) of the bracket 637, the surfaces facing each other. A restriction concave portion 639 is formed on each of front portions of the brackets 637.

The boarding step 636 is formed of a plate member, and includes a first attachment arm 640, a second attachment arm 641, a joint portion 642, a restriction portion 643, and a reinforcement plate 644.

A rear portion of the first attachment arm 640 is disposed on a position corresponding to the opposite surface of the bracket 637 disposed on the right side. An attachment bolt 645 attaches the rear portion of the first attachment arm 640 to the bracket 637 disposed on the right side by being screwed to the nut 638.

A rear portion of the second attachment arm 641 is disposed on a position corresponding to the opposite surface of the bracket 637 disposed on the left side. An attachment bolt 645 attaches the rear portion of the second attachment arm 641 to the bracket 637 disposed on the left side by being screwed to the nut 638.

The joint portion 642 joints a front end of the first attachment arm 640 and a front end of the second attachment arm 641 to each other.

The restriction portion 643 joints an intermediate portion of the first attachment arm 640 and an intermediate portion of the second attachment arm 641 to each other. The restriction portion 643 is inserted to the restriction concave portion 639 under a state where the first attachment arm 640 and the second attachment arm 641 are attached to the bracket 637.

The reinforcement plate 644 joints the joint portion 642 and the restriction portion 643 to each other. In the boarding step 636, the restriction portion 643 is inserted to the restriction concave portion 639, and thereby the boarding step 636 is prevented from turning (downward) to a direction of a load applied in the getting on and off. In this manner, a load applied to the attachment bolt 645 is reduced.

As shown in FIG. 10 and FIG. 11, a hose cover 646 is disposed on a position arranged behind the boarding step 636. The hose cover 646 is a cover configured to cover the third hose 625 and the fifth hose 627, the third hose 625 and the fifth hose 627 being arranged on and along the front joint pipe 7.

The hose cover 646 is fixed to a position on the joint pipe 7, the position being arranged behind the boarding step 636. The hose cover 646 is positioned just behind the boarding step 636. In addition, a position of an upper surface of the hose cover 646 is approximately as high as an upper end of the boarding step 636 in a side view.

The hose cover 646 includes an upper wall 647, a front wall 648, and a rear wall 649. The upper wall 647 is positioned above the front joint pipe 7. The front wall 648 protrudes from a front end of the upper wall 647 toward the front joint pipe 7. The rear wall 649 protrudes from a rear end of the upper wall 647 toward the front joint pipe 7. The front joint pipe 7 is provided with a nut member 650. The upper wall 647 (the hose cover 646) can be fixed when a fixation bolt 651 is screwed up after the fixation bolt 651 is inserted to the upper wall 647 and the nut member 650.

As shown in FIG. 11, the front joint pipe 7 includes a first wall 622, a second wall 653, and a third wall 654. The second wall 653 is disposed in front of the first wall 652. The first wall 652 is formed to have a shape curved forward, that is, toward the second wall 653. The second wall 653 is formed to have a shape curved forward, that is, toward a side opposite to the first wall 652.

A curvature of the first wall 652 is approximately as same as a curvature of the second wall 653. In the embodiment, the curvature of the first wall 652 is slightly larger than the curvature of the second wall 653. An interval between the first wall 652 and the second wall 653 are gradually reduced from upper portions of the first wall 652 and the second wall 653 toward lower portions of the first wall 652 and the second wall 653. That is, the more the first wall 652 and the second wall 653 separate from the third wall 654, the more the first wall 652 and the second wall 653 are close to each other. The first wall 652 and the second wall 653 are connected by a first connecting portion 655 at lower ends of the first wall 652 and the second wall 653, the first connecting portion 655 having an arc shape.

The third wall 654 is positioned above the first wall 652 and the second wall 653, that is, on a position opposite to the first connecting portion 655, and joints upper portions (one ends) of the first wall 652 and the second wall 653 to each other. A connecting portion 656 (a second connecting portion) joints the third wall 654 and the first wall 652 to each other, the connecting portion 656 having an arc shape. In addition, a connecting portion 657 (a third connecting portion 632) joints the third wall 654 and the second wall 653 to each other, the connecting portion 657 also having an arc shape.

As shown in FIG. 16, the front joint pipe 7 is inserted to the insertion concave portion 616, the insertion concave portion 616 being disposed on a rear portion of the boom front portion 601. The front wheel 5T is positioned behind a rear surface of the first wall 652 under a state where the boom 10 is pulled down. A rear surface of the first wall 652 has a shape corresponding to a shape of the front wheel 5F of the travel device 5. A curvature of the rear surface of the first wall 652 is configured to be approximately as same as a curvature of an outer circumferential surface of the front wheel 5F.

The front joint pipe 7 having the above described configuration includes: the first wall 652; the second wall 653 disposed in front of the first wall 652; and the third wall 654 jointing one end of the first wall 652 and one end of the second wall 653 to each other. In addition, the first wall 652 is formed to have a shape curved toward the second wall 653. The second wall 653 is formed to have a shape curved toward a side opposite to the first wall 652. The more the first wall 652 and the second wall 653 separate from the third wall 654, the more the first wall 652 and the second wall 653 are gradually close to each other. In this manner, the connecting portion between the boom 10 and the front joint pipe 7 can avoid a concentration of stress.

In addition, the rear surface of the first wall 652 is curved corresponding to the shape of the front wheel 5T of the travel device 5, thereby forming a space between the front wheel 5F and the first wall 652 under a state where the boom 10 is pulled down.

Moreover, the second wall 653 is approximately parallel to a cylinder tube of the bucket cylinder 15 when the bucket cylinder 15 is fully stretched. In this manner, the bucket cylinder 15 can be prevented from hitting the front joint pipe 7 certainly.

Meanwhile, in a conventional technique, the front joint pipe is formed of a combination of plate members connected by being welded to each other, thereby having a triangular cross section. The welding generates a strain in the conventional front joint pipe.

On the other hand, the front joint pipe 7 according to the embodiment is formed of a cylindrical pipe, the cylindrical pipe being deformed by a roller. In this manner, the strain is prevented from being generated in the front joint pipe 7.

Figure 12:
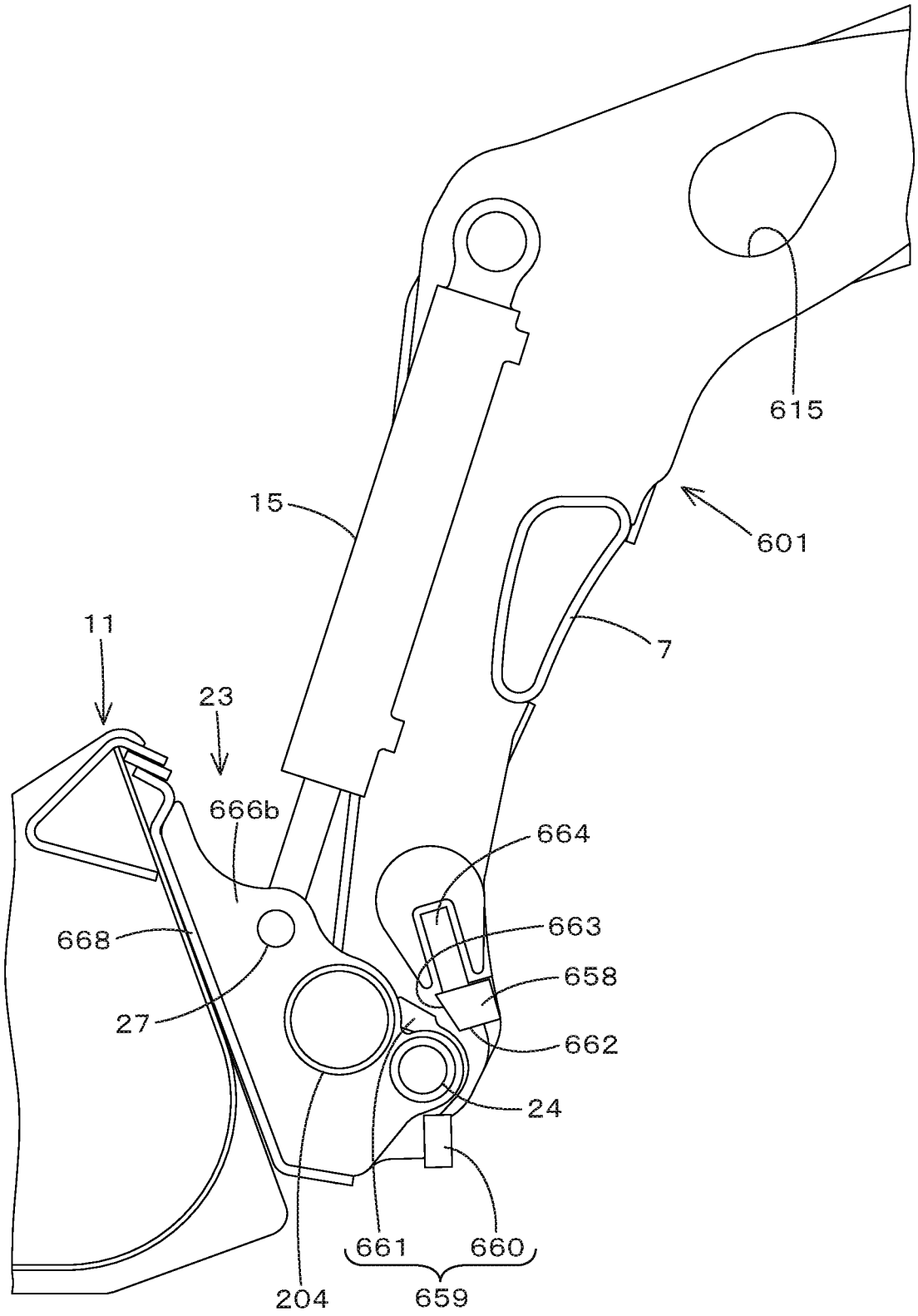
FIG. 12 is a side view of a front portion of the boom according to the embodiment, the boom being disposed on the right side.
Figure 13:
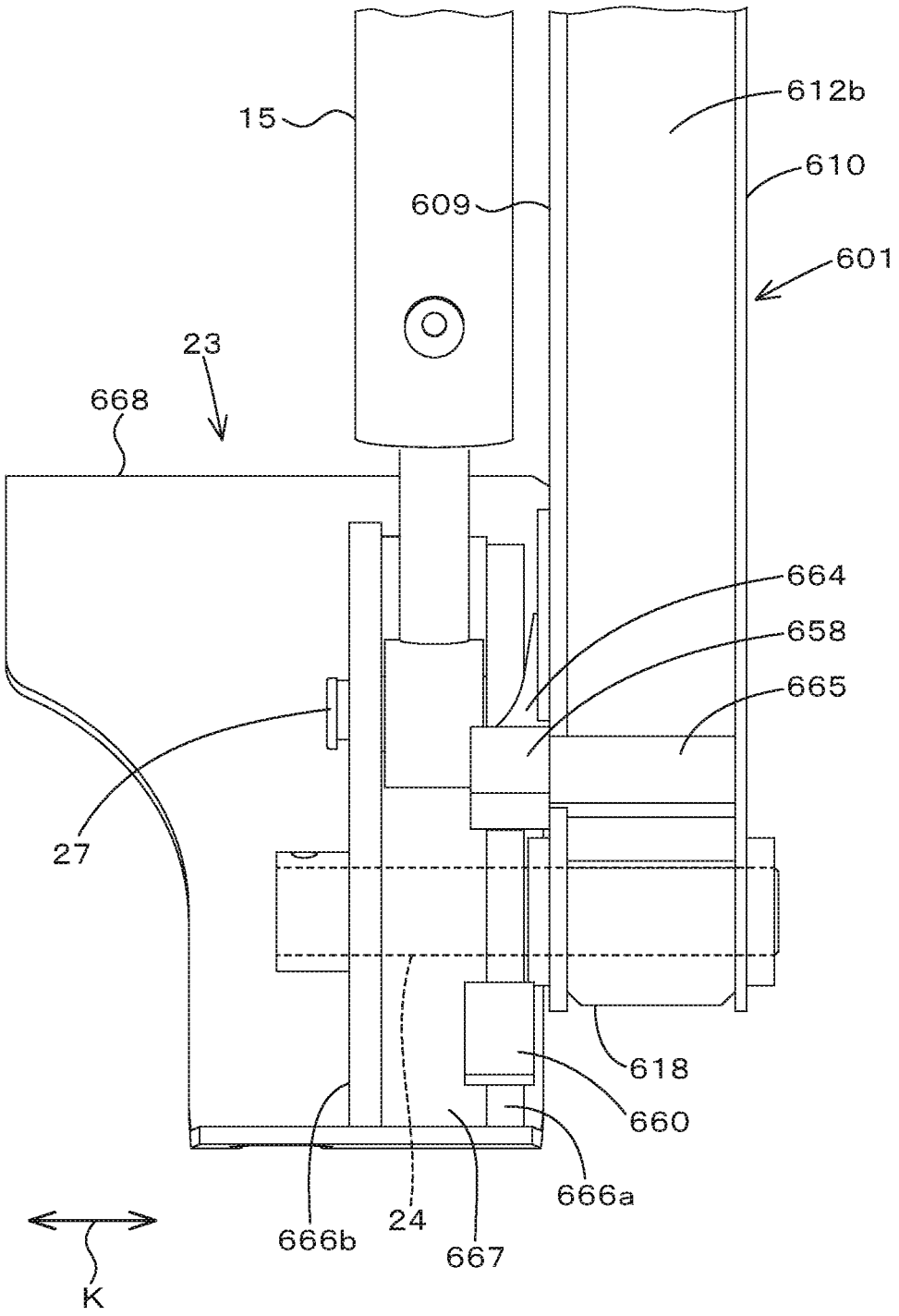
FIG. 13 is a back view of an attachment portion of an attachment body according to the embodiment.
Figure 14:
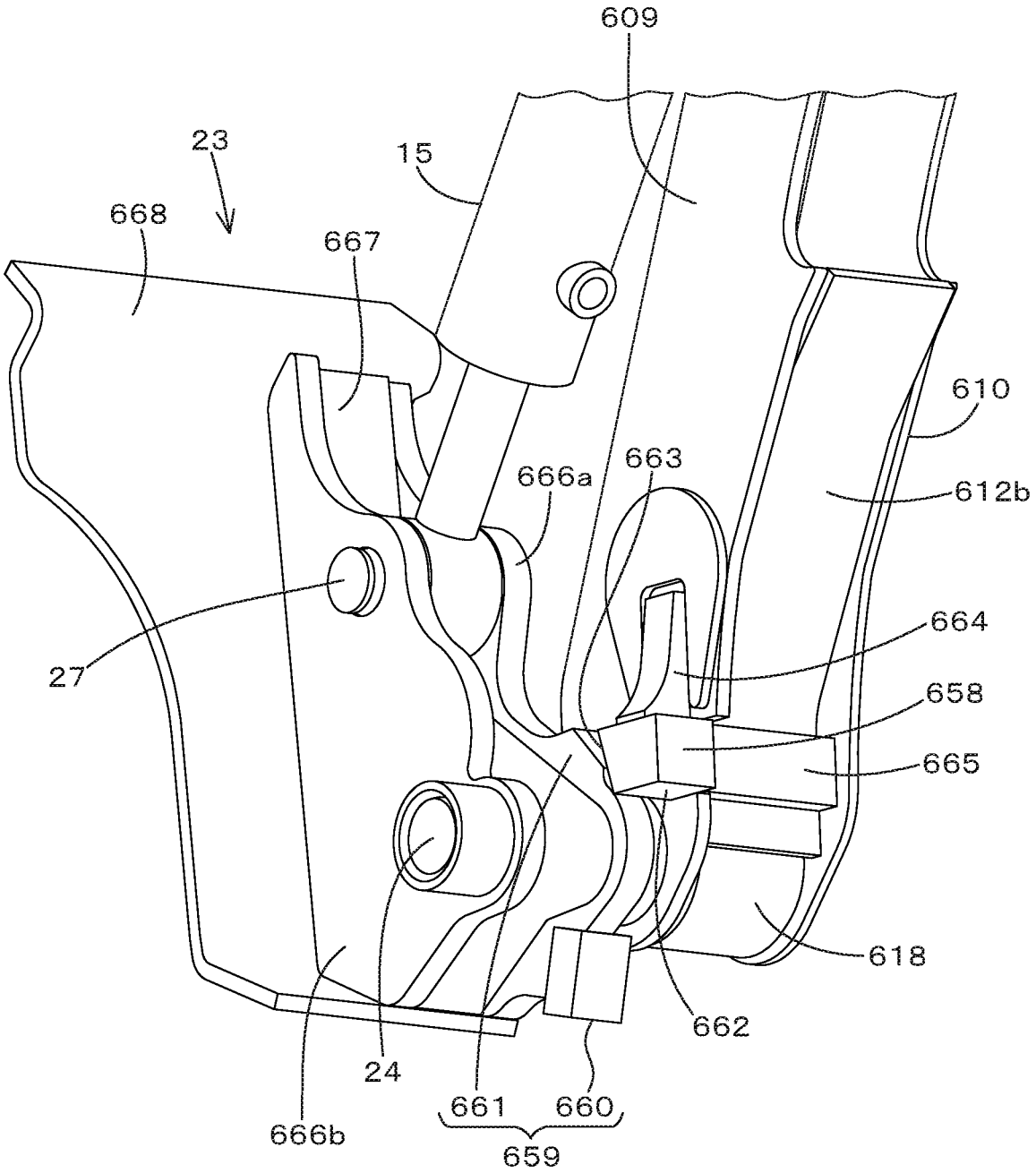
FIG. 14 is a perspective back view of the attachment portion of the attachment body according to the embodiment.

As shown in FIG. 12, FIG. 13, and FIG. 14, the boom front portion 601 is provided with a restriction stopper 658. The attachment body 23 is provided with a contact portion 659.

The contact portion 659 moves integrally with the attachment body 23 when the attachment body 23 turns. The contact portion 659 contacts to the restriction stopper 658, thereby restricting an end position of the turning of the attachment body 23.

The contact portion 659 includes a first contact portion. 660 and a second contact portion 661. The second contact portion 661 is disposed on a position different from a position of the first contact portion 660.

The restriction stopper 658 is formed to have a block shape, and includes a first contact surface 662 and a second contact surface 663.

The first contact portion 660 contacts to the first contact surface 662 when the bucket 11, that is, the attachment body 23 is turned toward one direction. In this manner, the first contact portion 660 restricts the turning toward one direction of the bucket 11. In particular, the first contact portion 660 contacts to the first contact surface 662 when the bucket 11 is turned toward a direction of dumping, thereby restricting the turn of the attachment body 23 in the dumping.

In addition, the second contact portion 661 contacts to the second contact surface 663 when the bucket 11, that is, the attachment body 23 is turned toward the other direction. In this manner, the second contact portion 661 restricts the turning toward the other direction of the bucket 11. In particular, the second contact portion 661 contacts to the second contact surface 663 when the bucket 11 is turned toward a direction of scooping, thereby restricting the turn of the attachment body 23 in the scooping.

The restriction stopper 658 is disposed on a side of the inner wall 609 of the boom front portion 601, the side being opposite to the outer wall 610. The restricting stopper 658 is fixed to the inner wall 609, the first reinforcement member 664, and the second reinforcement 665 by welding.

The first reinforcement member 664 is arranged above the restriction stopper 658. The first restriction member 664 is fixed to a side surface of the inner wall 609 by welding, the side surface being opposite to the outer wall 610.

The second reinforcement member 665 is arranged on a lower end of the second member 612*b* of the rear joint wall 612 and on a side of the restriction stopper 658. The second reinforcement member 665 is fixed to the second member 612*b* by welding.

In addition, a third reinforcement member 669 is disposed near (in the vicinity of) the first reinforcement member 664. The third reinforcement member 669 is fixed to a side surface of the inner wall 609 by welding, the side surface being opposite to the outer wall 610. A concave portion 670 is formed on the third reinforcement member 669, the concave portion 670 being configured to accept insertion of the first reinforcement member 664. The third reinforcement member 669 is intended to reinforce a portion for fixing the first reinforcement member 664, for example.

The restriction stopper 658 is disposed behind the tip end boss 618 of the boom front portion 601 and above the tip end boss 618.

Figure 15:
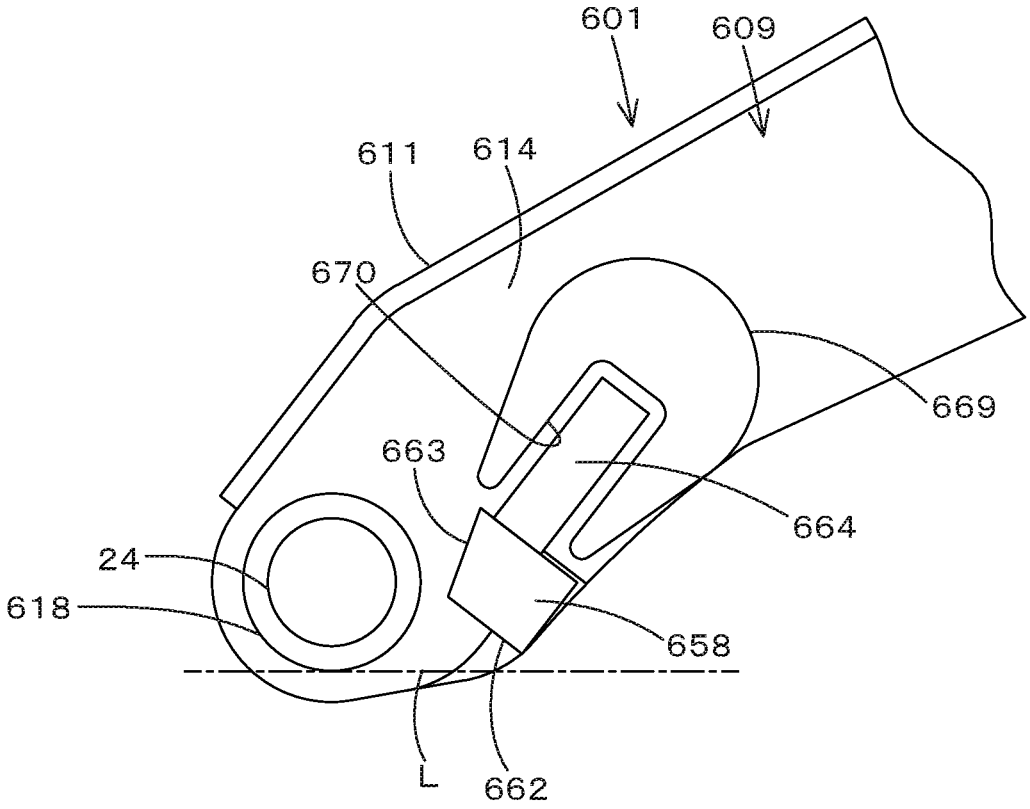
FIG. 15 is a side view showing a lower portion of a front portion of the boom according to the embodiment, the boom being lifted to the highest position.

FIG. 15 shows a lower portion of the boom front portion 601 under a state where the boom 10 is fully lifted up. As shown in FIG. 15, the restriction stopper 658 is positioned above a line L under the state where the boom 10 is fully lifted up, the line L showing a lower end of the tip end boss 618. That is, the restriction stopper 658 does not protrude downward from the tip end boss 618 under the state where the boom 10 is fully lifted up.

The attachment body 23 is arranged on a side of the inner wall 609 of the boom front portion 601, the side being opposite to the outer wall 610 of the boom front portion 601.

The attachment body 23 includes a pair of support plates 666*a* and 666*b*, a joint plate 667, and an attachment plate 668.

The pair of support plates 666*a* and 666*b* are disposed opposite to each other in the machine width direction K. Of the pair of support plates 666*a* and 666*b*, the support plate 666*a* is close to the boom front portion 601, being referred to as an outer support plate 666*a*, and the support plate 666*b* is far from the boom front portion 601, being referred to as an inner support plate 666*b*.

A pivotally supporting portion of a lower end of the bucket cylinder 15 is inserted to an upper portion between the outer support plate 666*a* and the inner support plate 666*b*, and thereby the second bucket cylinder 15 is pivotally supported by the bucket cylinder pin 27. The pivot pin 24 is disposed between a lower portion of the outer support plate 666*a* and a lower portion of the inner support plate 666*b*. The pivot pin 24 is inserted to the tip end boss 618 of the boom front portion 601 and is fixed to the tip end boss 618. In addition, the pivot pin 24 protrudes toward the attachment body 23, and penetrates the outer support plate 666*a* and the inner support plate 666*b*.

The joint plate 667 is disposed between the outer support plate 666*a* and the inner support plate 666*b*, and joints the outer support plate 666*a* and the inner support plate 666*b* to each other.

The attachment plate 668 is fixed to a front end side of the pair of support plates 666*a* and 666*b*. The attachment plate 668 is engaged to a hack surface of the bucket 11. The outer support plate 666*a* is disposed on a position corresponding to the restriction stopper 658, the position being on one side of the inner wall 609, the side being opposite to the outer wall 610. The first contact portion 660 and the second contact portion 661 are disposed on the outer support plate 666*a*.

In particular, the first contact portion 660 and the second contact portion 661 are disposed on an outer circumferential surface of the outer support plate 666*a*. The first contact portion 660 is formed of a block member, and is fixed to the outer circumferential surface of the outer support plate 666*a* by welding. The second contact portion 661 is formed integrally on a plate member constituting the outer support plate 666*a*.

As shown in FIG. 12, under a condition where the bucket 11 is installed, the first contact portion 660 is positioned below the pivot pin 24, and the second contact portion 661 is positioned above the pivot pin 24.

In a case where: the contact portion is disposed on an outer side surface of the attachment body 23; and the restriction stopper is disposed on a lower end side of the tip end portion of the boom front portion 601 as in a conventional technique, the contact portion has to protrude from an outer surface of the attachment body 23 toward the tip end portion of the boom 10. In the case where the contact portion protrudes outward from the outer side surface of the attachment body 23 toward the tip end portion of the boom 10, a large load is applied to a portion being attached to the contact portion when the contact portion contacts the restriction stopper in the turning of the bucket 11.

On the other hand, in the embodiment, the restriction stopper 658 is disposed on a side of the inner wall 609 of the front portion of the boom 10, the side being opposite to the outer wall 610. In addition, the contact portion 659 is disposed on the outer circumferential surface of the outer support plate 666*a*, the outer support plate 666*a* being disposed on a position corresponding to the restriction stopper 658, the position being on one side of the inner wall 609, the side being opposite to the outer wall 610.

Accordingly, it can be prevented that the contact portion widely protrudes from the portion being attached to the contact portion as in the conventional technique, thereby reducing a load applied to the contact portion 659 when the contact portion contacts the restriction stopper in the turning of the bucket 11.

In addition, considering a case where the restriction stopper is disposed on a lower end side of the tip end portion of the boom front portion 601 as in the conventional technique, the restriction stopper protrudes downward from the tip end boss 618 when the boom 10 is lifted up. Thus, the restriction stopper 658 tends to be hit to a tail gate of a load-carrying tray in an operation to load earth and sand on the load-carrying tray of a truck.

On the other hand, in the embodiment, the restriction stopper 658 is positioned above the tip end boss 618 and does not protrude downward from the tip end boss 618 under the state where the boom 10 is fully lifted up. In this manner, the steer skid loader 1 according to the embodiment is capable of realizing the maximum height of the bucket 11, the maximum height being effective in the loading operation, without hitting the restriction stopper 658 to the tail gate of the load-carrying tray in the operation of the loading to the load-carrying tray of the truck.

In the above description, the embodiment of the present invention has been explained. However, ail the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

What is claimed is:

1. A working machine comprising:

a machine body;

an operation tool;

a boom configured to swing upward and downward;

a pivot shaft disposed on a front portion of the boom, the front portion of the boom including:

an outer wall; and an inner wall disposed opposite to the outer wall;

a restriction stopper disposed on the front portion of the boom, the restriction stopper being disposed on a side of the inner wall, the side being opposite to the outer wall;

an attachment body supported by the pivot shaft to be capable of freely turning, the attachment body being for attachment of the operation tool, the attachment body including:

a support plate disposed on a position corresponding to the restriction stopper, the position being on the side of the inner wall, the side being opposite to the outer wall; and a contact portion configured to move when the attachment body turns, the contact portion being configured to contact to the restriction stopper, the contact portion being disposed on the support plate, wherein the contact portion includes:

a first contact portion disposed on an outer circumferential surface of the support plate, the first contact portion configured to contact to the restriction stopper when the operation tool is turned to one direction; and a second contact portion disposed on the outer circumferential surface at a position different from a position of the first contact portion, the second contact portion configured to contact to the restriction stopper when the operation tool is turned to the other direction.

2. The working machine according to claim 1, wherein the front portion of the boom includes:

a boss portion configured to support the pivot shaft, and the restriction stopper is disposed above a lower end of the boss portion.

3. The working machine according to claim 2, wherein the restriction stopper is disposed on a position where the restriction stopper does not protrude downward from the boss portion under a state where the boom is fully lifted up.

4. The working machine according to claim 1, wherein the restriction stopper has:

a first contact surface to which the first contact portion is contacted; and a second contact surface to which the second contact portion is contacted.

* * * * *